US006285848B1

(12) United States Patent
Aita et al.

(10) Patent No.: US 6,285,848 B1
(45) Date of Patent: Sep. 4, 2001

(54) ELECTROPHOTOGRAPHIC APPARATUS, IMAGE FORMING METHOD, AND PROCESS CARTRIDGE FOR DEVELOPING AN IMAGE WITH TONER CONTAINING AN EXTERNAL ADDITIVE

(75) Inventors: Shuichi Aita, Mishima; Kenji Okado, Yokohama; Toshiyuki Ugai, Tokyo; Ryoichi Fujita, Odawara; Fumihiro Arahira, Shizuoka-ken; Kiyoshi Mizoe, Numazu; Yoshifumi Hano, Susono, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/092,935

(22) Filed: Jun. 8, 1998

(30) Foreign Application Priority Data

Jun. 13, 1997 (JP) ..... 9-155629
Jun. 13, 1997 (JP) ..... 9-156810

(51) Int. Cl.[7] ..... G03G 15/02
(52) U.S. Cl. ..... 399/175; 399/149
(58) Field of Search ..... 399/149, 175, 399/174, 176; 361/225

(56) References Cited

U.S. PATENT DOCUMENTS

| | | | | |
|---|---|---|---|---|
| 5,351,109 | * | 9/1994 | Haneda | 399/175 |
| 5,482,805 | * | 1/1996 | Grande et al. | 430/106 |
| 5,713,067 | | 1/1998 | Mizoe et al. | 399/176 |
| 5,715,501 | | 2/1998 | Aita et al. | 399/159 |
| 5,790,926 | | 8/1998 | Mizoe et al. | 399/174 |
| 5,805,961 | | 9/1998 | Mizoe et al. | 399/174 |
| 5,890,037 | * | 3/1999 | Kukimoto et al. | 399/175 |
| 5,895,151 | * | 4/1999 | Kinoshita et al. | 399/284 |

FOREIGN PATENT DOCUMENTS

| | | |
|---|---|---|
| 0 354 310 | 2/1990 | (EP) . |
| 0 709 746 A1 | 5/1996 | (EP) . |
| 0 715 230 A1 | 6/1996 | (EP) . |
| 56-104351 | 8/1981 | (JP) . |
| 57-178257 | 11/1982 | (JP) . |
| 58-40566 | 3/1983 | (JP) . |
| 58-150975 | 9/1983 | (JP) . |
| 59-133569 | 7/1984 | (JP) . |

OTHER PUBLICATIONS

"Polymer Handbook", 2$^{nd}$ edition edited by J. Brandrup and E. H. Immergut; John Wiley & Sons 1975, pp. III–139 through III–192.

Pat. Abs. of Japan, vol. 095, No. 006, Jul. 31, 1995 (JP 07 072667 A).

*Primary Examiner*—Quana M. Grainger
(74) *Attorney, Agent, or Firm*—Fitzpatrick, Cella, Harper & Scinto

(57) ABSTRACT

An electrophotographic apparatus includes an electrophotographic photosensitive member, and (i) a charger, (ii) an imagewise exposure device, (iii) a developing device and (iv) a transfer device, disposed in this order opposite to the photosensitive member. The charger includes a charging member including magnetic particles disposed in contact with the photosensitive member so as to charge the photosensitive member based on a voltage received thereby. The magnetic particles are surface-coated with a coupling agent having a linear alkyl group having a least 6 carbon atoms. The developing device also functions to recover residual toner remaining on the photosensitive member processing by the transfer device and the charger. Because of the coating with such a specific coupling agent, the charging magnetic particles can exhibit good triboelectric changeability for the transfer residual toner for a long period.

63 Claims, 9 Drawing Sheets

FOREIGN PATENT DOCUMENTS

| | | |
|---|---|---|
| 59-133573 | 7/1984 | (JP) . |
| 62-203182 | 9/1987 | (JP) . |
| 63-133179 | 6/1988 | (JP) . |
| 64-20587 | 1/1989 | (JP) . |
| 2-51168 | 2/1990 | (JP) . |
| 2-302772 | 12/1990 | (JP) . |
| 4-21873 | 1/1992 | (JP) . |
| 4-116674 | 4/1992 | (JP) . |
| 5-2287 | 1/1993 | (JP) . |
| 5-2289 | 1/1993 | (JP) . |
| 5-53482 | 3/1993 | (JP) . |
| 5-61383 | 3/1993 | (JP) . |
| 58-139156 | 8/1993 | (JP) . |
| 6-118855 | 4/1994 | (JP) . |
| 7-72667 | 3/1995 | (JP) . |
| 8-240952 | 9/1996 | (JP) . |

* cited by examiner

ELECTROPHOTOGRAPHIC APPARATUS, IMAGE FORMING METHOD, AND PROCESS CARTRIDGE FOR DEVELOPING AN IMAGE WITH TONER CONTAINING AN EXTERNAL ADDITIVE

FIELD OF THE INVENTION AND RELATED ART

The present invention relates to an electrophotographic apparatus including a charging means comprising a charging member formed of magnetic particles and a developing means also functioning as a substantial cleaning means. The present invention relates to an image forming method using such an electrophotographic apparatus and a process cartridge constituting a vital part of such an electrophotographic apparatus.

Hitherto, a large number of electrophotographic processes have been known. In these processes, an electrostatic latent image is formed on a photosensitive member, comprising a photoconductive material, by various means, then the latent image is developed and visualized with a toner, and the resultant toner image is, after being transferred onto a transfer-receiving material, such as paper, as desired, fixed by heating, pressing, heating and pressing, etc., to obtain a copy or a print. The residual toner remaining on the photosensitive member without being transferred is removed in a cleaning step. In such electrophotographic apparatus, corona discharge means, such as a so-called corotron or scorotron, have been conventionally used as charging means, but are accompanied by difficulties, such that a substantial amount of ozone occurs at the time of the corona discharge for forming a negative corona or a positive corona, and the electrophotographic apparatus is required to be equipped with a filter for removing the ozone, resulting in a size enlargement and an increase in the running cost of the apparatus.

As a technical solution of such difficulties, a charging method for minimizing the occurrence of ozone has been developed, wherein a charging means, such as a roller or a blade, is caused to contact the photosensitive member surface to form a narrow gap in the proximity of the contact portion where a discharge, appearing to follow the Paschen's law, occurs (contact charging scheme), e.g., as disclosed in Japanese Laid-Open Patent Application (JP-A) 57-178257, JP-A 56-104351, JP-A 58-40566, JP-A 58-139156 and JP-A 58-150975.

According to the contact charging scheme, however, there is liable to occur a difficulty, such as toner melt-sticking onto the photosensitive member. For this reason, there is also proposed a scheme of disposing a charging member in proximity to a photosensitive member so as to avoid a direct contact therebetween. The member for charging a photosensitive member may assume the form of a roller, a blade, a brush or an elongated plate member coated with a resistance layer. Any of such members still have difficulty in accurate proximity control, thus leaving a difficulty in practical application.

As another alternative, it has been also proposed to use magnetic particles held on an electroconductive sleeve enclosing a magnet as a charging member exerting a relatively small contacting lead onto the photosensitive member. For example, JP-A 59-133569 discloses a method wherein iron-coated particles are held on a magnet roll and supplied with a voltage to charge a photosensitive member; JP-A 4-116674 discloses a charging apparatus supplied with an AC-superposed DC voltage; and JP-A 7-72667 discloses magnetic particles coated with a styrene-acrylic resin so as to exhibit improved environmental stability.

On the other hand, in the cleaning step, a blade, a fur brush, a roller, etc., have been conventionally used as cleaning means. By cleaning means or member, the transfer residual toner is mechanically scraped off or held back, to be recovered into a waste toner vessel. Accordingly, some problems have been caused by pressing of such a cleaning member against the photosensitive member surface. For example, by strongly pressing the member, the photosensitive member can be worn out, resulting in a short life of the photosensitive member. Further, from an apparatus viewpoint, the entire apparatus is naturally enlarged because of the provision of such a cleaning device, thus providing an obstacle against a general demand for a smaller apparatus.

Further, from an ecological viewpoint and effective utilization of a toner, a system not resulting in a waste toner has been desired.

In order to solve the above-mentioned problems accompanying the provision of a separate cleaning system, a so-called simultaneous developing and cleaning system or cleaner-less system has been proposed wherein a separate cleaning means for recovering and storing residual toner remaining on the photosensitive member after the transfer step is not provided between the transfer position and the charging position or between the charging position and the developing position, but the cleaning is performed by the developing means. Examples of such a system are disclosed in JP-A 59-133573, JP-A 62-203182, JP-A 63-133179, JP-A 64-20587, JP-A 2-51168, JP-A 2-302772, JP-A 5-2287, JP-A 5-2289, JP-A 5-53482 and JP-A 5-61383. In these proposed systems, a corona charge, a fur brush charger and a roller charger are used as the charging means, and it has not been fully successful to solve problems, such as the soiling of the photosensitive member surface with discharge products, and charging non-uniformity.

For this reason, a cleaner-less system using a magnetic brush as a charging member has been proposed. For example, JP-A 4-21873 discloses an image forming apparatus using a magnetic brush supplied with an AC voltage having a peak-to-peak voltage exceeding a discharge threshold value for unnecessitating a cleaning apparatus. Further, JP-A 6-118855 discloses an image forming apparatus including a simultaneous magnetic brush charging and cleaning system without using an independent cleaning apparatus.

However, these prior art references fail to disclose specific forms of charging magnetic particles suitable for a cleaner-less system, thus leaving a technical problem in this respect.

More specifically, it is desired to provide a charging member capable of exhibiting a stable charging performance and treating a transfer residual toner in a form suitable form for recovery by a developing means, this being suitable for use in a cleaner-less system.

SUMMARY OF THE INVENTION

An object of the present invention is to provide an electrophotographic apparatus including a magnetic brush and a cleaner-less system and capable of providing stable images continually for a long period.

Another object of the present invention is to provide an electrophotographic apparatus including a magnetic brush charger capable of effectively preventing toner scattering therefrom through the use of improved magnetic particles.

A further object of the present invention is to provide an image forming method using such an electrophotographic apparatus and a process cartridge forming a vital part of such an electrophotographic apparatus.

According to the present invention, there is provided an electrophotographic apparatus, comprising: an electrophotographic photosensitive member, and (i) charging means, (ii) imagewise exposure means, (iii) developing means and (iv) transfer means, disposed in this order opposite to the photosensitive member, wherein said charging means includes a charging member comprising magnetic particles disposed in contact with the photosensitive member so as to charge the photosensitive member based on a voltage received thereby, said magnetic particles are surface-coated with a coupling agent having a linear alkyl group having at least 6 carbon atoms, and said developing means also functions to recover residual toner remaining on the photosensitive member after processing by the transfer means and the charging means.

According to another aspect of the present invention, there is provided an image forming method, comprising a cycle of:

a charging step of charging an electrophotographic photosensitive member by a charging means disposed in contact with the photosensitive member, an exposure step of exposing the charged photosensitive member to image light to form an electrostatic image on the photosensitive member, a developing step of developing the electrostatic image with a toner supplied from a developing means to form a toner image on the photosensitive member, and a transfer step of transferring the toner image on the photosensitive member onto a transfer-receiving material; wherein the charging means includes a charging member comprising magnetic particles disposed in contact with the photosensitive member so as to charge the photosensitive member based on a voltage received thereby, the magnetic particles are surface-coated with a coupling agent having a linear alkyl group having at least 6 carbon atoms, and residual toner remaining on the photosensitive member after the transfer step is processed by the charging member and recovered by the developing means in the charging step after the developing step, respectively, in a subsequent cycle.

According to still another aspect of the present invention, there is provided a process cartridge, comprising: an electrophotographic photosensitive member and a charging means forming an integral unit, which is detachably mountable to a main assembly to form an electrophotographic photosensitive member; the electrophotographic apparatus including the electrophotographic photosensitive member, and (i) the charging means, (ii) imagewise exposure means, (iii) developing means and (iv) transfer means, disposed in this order opposite to the photosensitive member, wherein the charging means includes a charging member comprising magnetic particles disposed in contact with the photosensitive member so as to charge the photosensitive member based on a voltage received thereby, the magnetic particles are surface-coated with a coupling agent having a linear alkyl group having at least 6 carbon atoms, and the developing means also functions to recover residual toner remaining on the photosensitive member after processing by the transfer means and the charging means.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
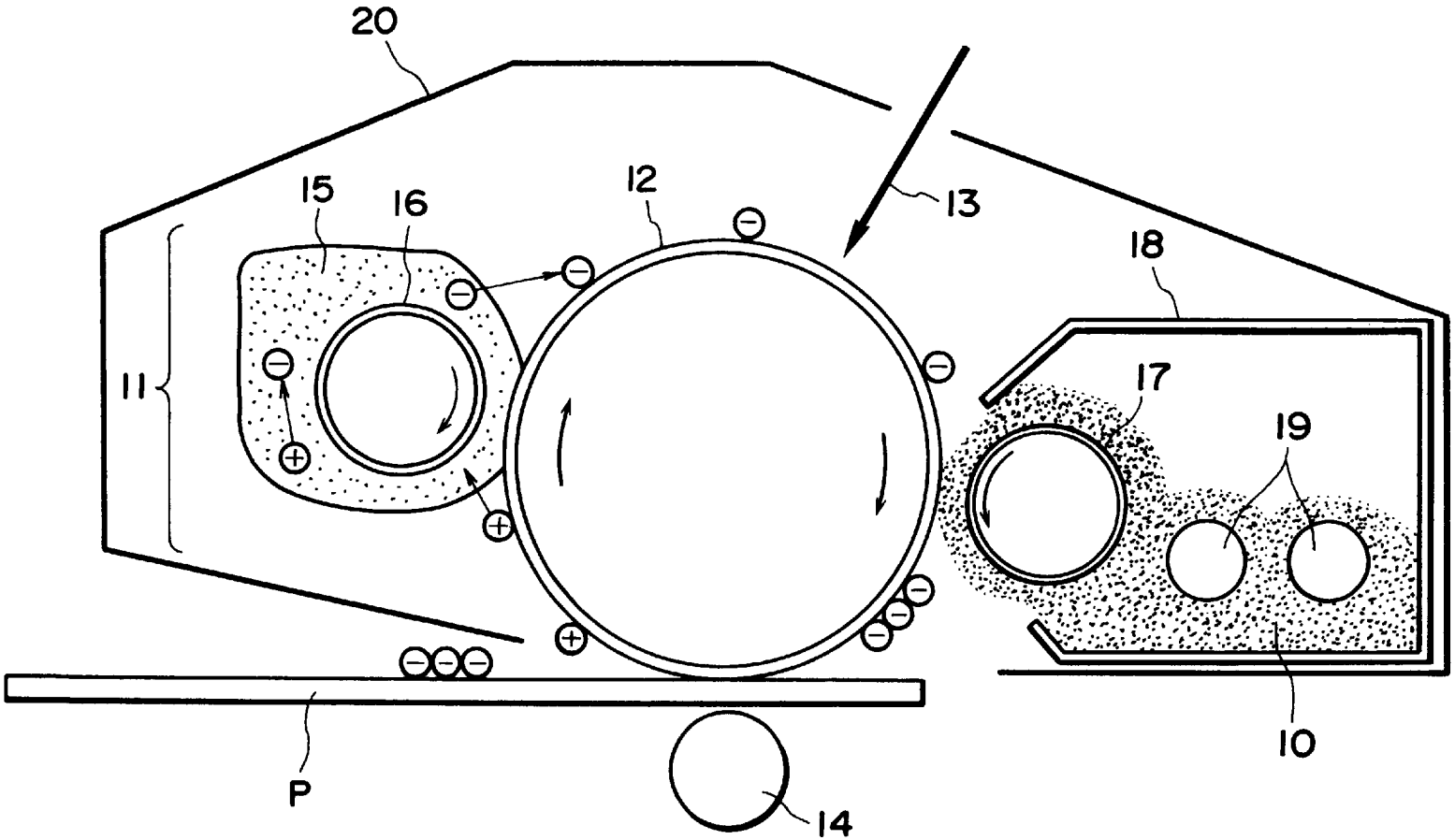
FIG. 1 is a schematic illustration of an embodiment of the electrophotographic apparatus according to the invention including a process cartridge.

The electrophotographic apparatus according to the present invention includes an electrophotographic photosensitive member, and (i) charging means, (ii) imagewise exposure means, (iii) developing means and (iv) transfer means, disposed in this order opposite to the photosensitive member, preferably in this order around a cylindrical form of the photosensitive member (i.e., photosensitive drum). The charging means includes a charging member comprising magnetic particles disposed in contact with the photosensitive member so as to charge the photosensitive member based on a voltage received thereby; the magnetic particles are surface-coated with a coupling agent having a linear alkyl group having at least 6 carbon atoms; and the developing means also functions to recover residual toner remaining on the photosensitive member after processing by the transfer means and the charging means.

Because of the use of the charging magnetic particles exhibiting a suitable resistance level and a stable charging performance in continuous use with little dependence on changes in environmental conditions, the electrophotographic apparatus according to the present invention can constitute an image forming system including particularly a cleaner-less system and is capable of exhibiting stable image forming performance for a long period.

Further, it is possible to realize an image forming system exerting little load on the photosensitive member and exhibiting high durability. Further as toner scattering from the charger is suppressed, soiling within the apparatus can be minimized.

Hereinbelow, the present invention will be described more specifically.

In order to realize an excellent cleaner-less system, it is necessary to study a principle for good processing and transfer of residual toner so as not to adversely effects to the resultant images. For example, JP-A 8-240952 has proposed a simultaneous developing and cleaning system wherein corona charging or discharging for charging a photosensitive member is utilized to control the transfer residual toner to a polarity identical to that of the photosensitive member, and the photosensitive member and the transfer residual toner held thereon are subjected to simultaneous developing and cleaning.

According to our study, however, it has been found possible to control well the polarity of transfer residual toner while charging the photosensitive member by contact charging without relying on corona charging or discharging at the time of charging the photosensitive member, if a charging means including a magnetic brush, formed of specific magnetic particles as a charging member, is used, thereby arriving at the present invention.

The principle of the present invention will now be described based on an embodiment with reference to FIG. 1.

A magnetic brush charger 11 is constituted by a non-magnetic electroconductive sleeve 16 enclosing a magnet therein and magnetic particles 15 held thereon and is used to charge a photosensitive member 12. The thus-charged photosensitive member 12 is exposed to image light 13 from an exposure means (not shown) to form an electrostatic latent image thereon. The latent image is subjected to reversal development by a developing apparatus 18 including e.g., a developer 10, an electroconductive non-magnetic sleeve 17 enclosing therein a magnet and stirring screws 19 for stirring the developer 10 in the apparatus to form a visualized toner image on the photosensitive member 12. The toner image is then transferred onto a transfer-receiving material P, such as paper, by a transfer means 14 to leave transfer residual toner on the photosensitive member 12. The transfer residual toner can have various charge polarities ranging from negative to positive (positively charged residual toner particles are represented by ⊕ in FIG. 1) according to the influence of a transfer bias electric field exerted by the transfer means. Such transfer residual toner is subjected to rubbing with a rotating magnetic brush charger 11 comprising the photosensitive members 15, thereby being scraped off and controlled to a desired polarity (negative in this embodiment) due to triboelectrification with the magnetic particles 15 while the photosensitive member 12 is charged by the magnetic brush charger 11 (to a negative charge). The charge controlled residual toner particles are distributed uniformly at a very low density on the photosensitive member and are subjected to a subsequent image forming cycle, thus leaving substantially no adverse effects on the subsequent image forming cycle, including the imagewise exposure step.

Accordingly, even in the case of using a so-called magnetic brush charger utilizing a discharge phenomenon, it becomes possible to allow clear image formation by utilizing discharge or triboelectrification with the magnetic particles constituting the magnetic brush and without using a separate cleaning means.

Further, even in the case of using a contact injection charging system not utilizing a discharge phenomenon, the transfer residual toner can be controlled to a desired polarity owing to triboelectrification with the magnetic particles, thereby allowing clear image formation without using a separate cleaning means.

As a result of further study based on the above-mentioned consideration on the principle, it has been found that the following problems remain to be solved in a cleanerless image forming apparatus using a charging member comprising magnetic particles for commercialization.

When the charging device is continually used for a long period, the surface property of the charging magnetic particles can be changed to fail in sufficiently controlled triboelectrification of the transfer residual toner, thus leading to toner scattering from the charging device or image fog due to insufficient control of the triboelectric charge polarity of the toner.

According to our study, the surface property change is caused by severe degradation of magnetic particles as the charging member due to a large load of friction between the magnetic particles themselves.

The composition of magnetic particles as a charging member may appear at a glance to be similar to that of magnetic carrier particle contained in a two-component type electrophotographic developer. However, in such a developer containing a substantial amount of toner, the abrasive contact between the carrier particles is suppressed due to the presence of toner particles functioning as a particulate lubricant, and the contact between individual carrier particles is suppressed, and the contact between the toner and carrier surfaces provides a predominant design factor. Further, the carrier particles moderately contact the photosensitive member in the developing, but the charging magnetic particles intimately contact the photosensitive member. Thus, the charging magnetic particles operate under substantially different conditions and are required to satisfy utterly different properties when compared with the carrier magnetic particles for developing.

More specifically, it has become clear that the charging magnetic particles are required to retain a property of triboelectrically charging the transfer residual toner in resistance to severe contact between individual magnetic particles and contact between the magnetic particles and the photosensitive member, while retaining the performance of charging the photosensitive member.

As a result of our further study for providing magnetic particles for charging satisfying the above requirements, it has been found critical to use magnetic particles coated with a coupling agent having a linear alkyl group having at least 6 carbon atoms. The present invention has been made based on this knowledge.

Herein, the term "coupling agent" refers to a compound having a molecular structure including a central element, such as silicon, aluminum titanium or zirconium, and a hydrolyzable group and a hydrophobic group.

The coupling agent used in the present invention has a hydrophobic group portion including an alkyl group having at least 6 carbon atoms connected in a straight chain. Because of the presence of such an alkyl group showing an electron-donating property, the magnetic particles of the present invention are believed to facilitate the triboelectrification for imparting negative charge to the transfer residual toner. Further, the alkyl group shows a relatively strong resistance to oxidation and is resistant to mechanical and/or thermal degradation due to friction between individual magnetic particles. Further, even in the case of molecular chain severance, the long alkyl chain can leave a certain length of alkyl group portion, thus resulting in little change in triboelectrification performance.

For the above reason, the alkyl group is required to have at least 6 carbon atoms, preferably at least 8 carbon atoms, further preferably at least 12 carbon atoms, and at most 30 carbon atoms, connected in a straight chain. Below 6 carbon atoms, the remarkable effect according to the present invention cannot be attained. On the other hand, above 30 carbon atoms, the coupling agent is liable to be insoluble in a solvent so that the uniform surface-treating therewith of the magnetic particles becomes difficult, and the treated charging magnetic particles are liable to have inferior flowability, thus exhibiting non-uniform charging performance.

The coupling agent may preferably be present in an amount of 0.0001–0.5 wt. % of the resultant charging magnetic particles. Below 0.0001 wt. %, it becomes difficult to attain the effect of the coupling agent. Above 0.5 wt. %, the charging magnetic articles are liable to have inferior flowability. It is further preferred that the coating amount is 0.001–0.2 wt. %.

The content of the coupling agent can be evaluated by the heating loss of the treated magnetic particles. Accordingly, the charging magnetic particles used in the present invention may preferably exhibit a heating loss of at most 0.5 wt. %, more preferably at most 0.2 wt. %, in terms of a % weight loss measured by a thermobalance when heated from 150° C. to 800° C. in a nitrogen atmosphere.

In the present invention, the magnetic particles may preferably be coated with the coupling agent alone but can be coated with the coupling agent in combination (i.e., in mixture or in superposition) with a resin, preferably in a minor amount of at most 50 wt. % of the total coating.

Further, the coupling agent-coated magnetic particles can be used in combination with resin-coated magnetic particles in an amount of preferably at most 50 wt. % of the total charging magnetic particles contained in the charging device. Above 50 wt. %, the effect of the charging magnetic particles according to the present invention can be diminished.

As far as having a hydrophobic group portion including a linear alkyl group having at least 6 carbon atoms, the coupling agent used in the present invention may have any central atom, such as titanium, aluminum, silicon or zirconium. However, titanium or aluminum is particularly preferred because of the availability and inexpensiveness of the material.

The coupling agent has a hydrolyzable group. Preferred examples thereof may include alkoxy groups having relatively high hydrophillicity, such as methoxy group, ethoxy group, propoxy group and butoxy group. In addition, it is also possible to use acryloxy group, methacryloxy group, halogen, or a hydrolyzable derivative of these.

The hydrophobic group of the coupling agent includes a linear alkyl group structure having 6 carbon atoms in a straight chain, which may be bonded to the central atom via a carboxylic ester, alkoxy, sulfonic ester or phospholic ester bond structure, or directly. The hydrophobic group can further include a functional group, such as an ether bond, an epoxy group or an amide group in its structure.

Preferred but non-exaustive examples of compounds used preferably as coupling agents in the present invention may include the following

[Compound]

(1)

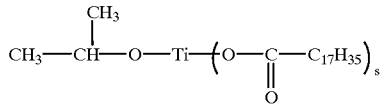

(2)

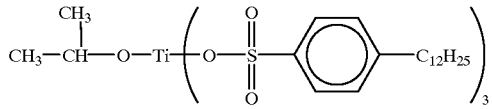

(3)

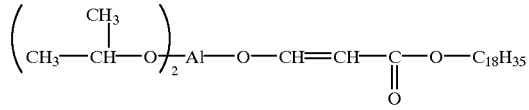

(4)

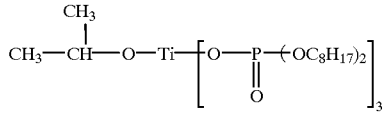

(5)

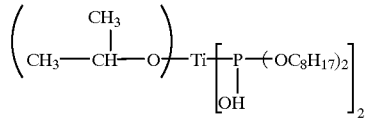

(6)

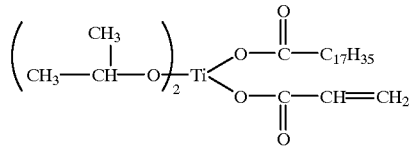

(7)

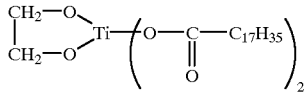

$C_6H_{13}$—$SiCl_3$ (8)

(9)

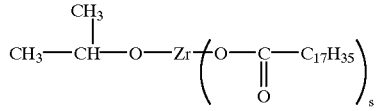

$C_6H_{13}$—$Si(OC_2H_5)_3$ (10)

The charging magnetic particles used in the present invention may preferably have a volume resistivity of $1\times10^4$–$1\times10^9$ ohm.cm. Below $1\times10^4$ ohm.cm, the magnetic particles are liable to cause pinhole leakage, and in excess of $1\times10^9$ ohm.cm, the magnetic particles are liable to exhibit inferior performance of charging the photosensitive member.

As the coupling agent used in the present invention can exhibit a sufficient effect at a coating level of at most 0.5 wt. %, preferably at most 0.2 wt. %, the coated charging magnetic particles of the present invention can exhibit a resistivity comparable to that of non-coated magnetic particles and accordingly can exhibit higher stability in production or of quality than magnetic particles surface-coated with a layer of electroconductive particle-dispersed resin.

Magnetic particles constituting a core of the charging magnetic particles may comprise a magnetic material, examples of which may include: so-called hard ferrites of strontium, barium, rare earth elements, etc.; magnetite and ferrites of copper, zinc, nickel, manganese, etc.

Figure 2:
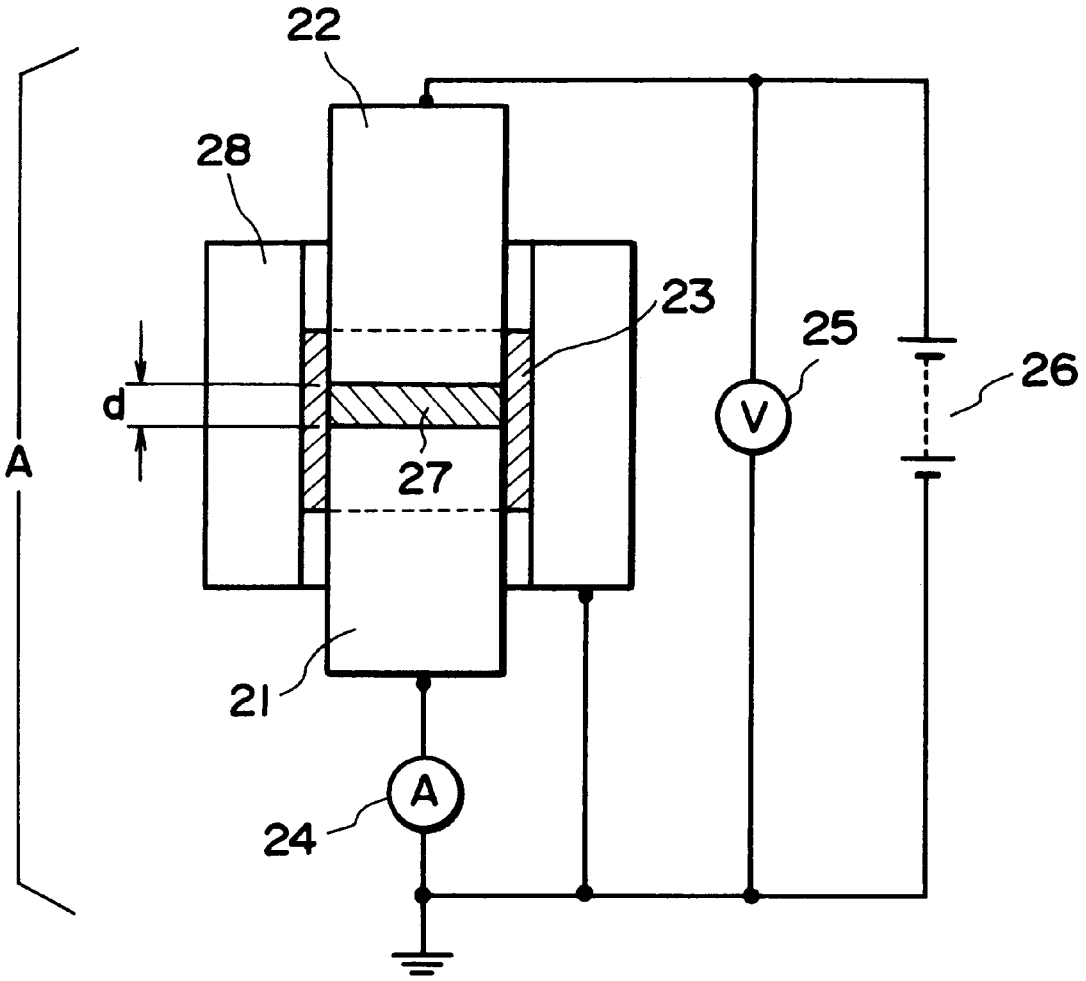
FIG. 2 is an illustration of an apparatus for measuring the volume resistivity of magnetic particles.

Incidentally, the volume resistivity values of magnetic particles described herein are based on values measured in the following manner. A cell A as shown in FIG. 2 is used. Into the cell A having a sectional area S (=2 $cm^2$) and held in a guide ring 28 via an insulating material 23, magnetic particles 27 are placed, and a principal electrode 21 and an upper electrode 22 are disposed to sandwich the magnetic particles 27 in a thickness d (=1 mm), under a load of 10 kg. Under this state, a voltage of 100 volts supplied from a constant voltage supply 26 and measured by a volt meter 23 is applied, and a current passing through the sample magnetic particles 27 is measured by an ammeter 24 in an environment of 23° C. and 65%.

In the present invention, the charging magnetic particles may preferably have particle sizes in the range of 5–100 $\mu$m. More specifically, below 5 $\mu$m, the magnetic particles are liable to be leaked out of the charging device, and above 100 $\mu$m, the magnetic particles are liable to exhibit a noticeable non-uniform charging ability. Particularly, in the injection charging system wherein the photosensitive member is charged only through points of contact with the magnetic particles, the magnetic particles may preferably have an average particle size of at most 50 $\mu$m, more preferably at most 35 $\mu$m, so as to provide an increased contact probability, thereby ensuring a sufficient ability of charging the photosensitive member.

On the other hand, in the charging system utilizing discharge, an average particle size of at least 40 $\mu$m, particularly at least 50 $\mu$m, is preferred. This is because magnetic particles having an average particle size of below 40 $\mu$m, when used in such a discharge-cased contact charging system, are liable to fall off the charging device since a voltage exceeding a discharge initiation voltage is always applied between the charging magnetic brush and the photosensitive member.

From the viewpoint of preventing toner scattering out of the charging device, the injection charging system is preferred to the discharge-based charging system wherein a substantially higher alternating electric field is required to cause severer vibration of the magnetic particles and magnetic particles having a larger particle size are used.

The average particle size values of magnetic particles referred to herein are based on values measured by using a laser diffraction-type particle size diffraction meter ("HEROS", available from Nippon Denshi K.K.) in.a range of 0.5–200 $\mu$m divided into 32 fractions on a logarithmic scale, and based on a measured distribution, a median particle size (diameter) giving cumulatively a volume corresponding to 50% of the total volume is taken as an average particle size (volume 50%-average particle size, denoted by Dav. or $D_{V50}$%).

The charging magnetic particles used in the present invention may preferably exhibit a certain range of charging ability for the toner used in combination therewith in terms of a triboelectric charge of the toner charged therewith. More specifically, the toner used may preferably exhibit an absolute value of a triboelectric charge in the range of 1–90 mC/kg, more preferably 5–80 mC/kg and further preferably 10–40 mC/kg, of a charging polarity identical to that of the photosensitive member charged thereby, so as to provide a good balance among toner take-in and send-out performances and the ability of charging the photosensitive member, when a mixture of 100 wt. parts of the magnetic particles and 7 wt. parts of the toner used is subjected to a triboelectric chargeability measurement in the following manner.

Figure 3:
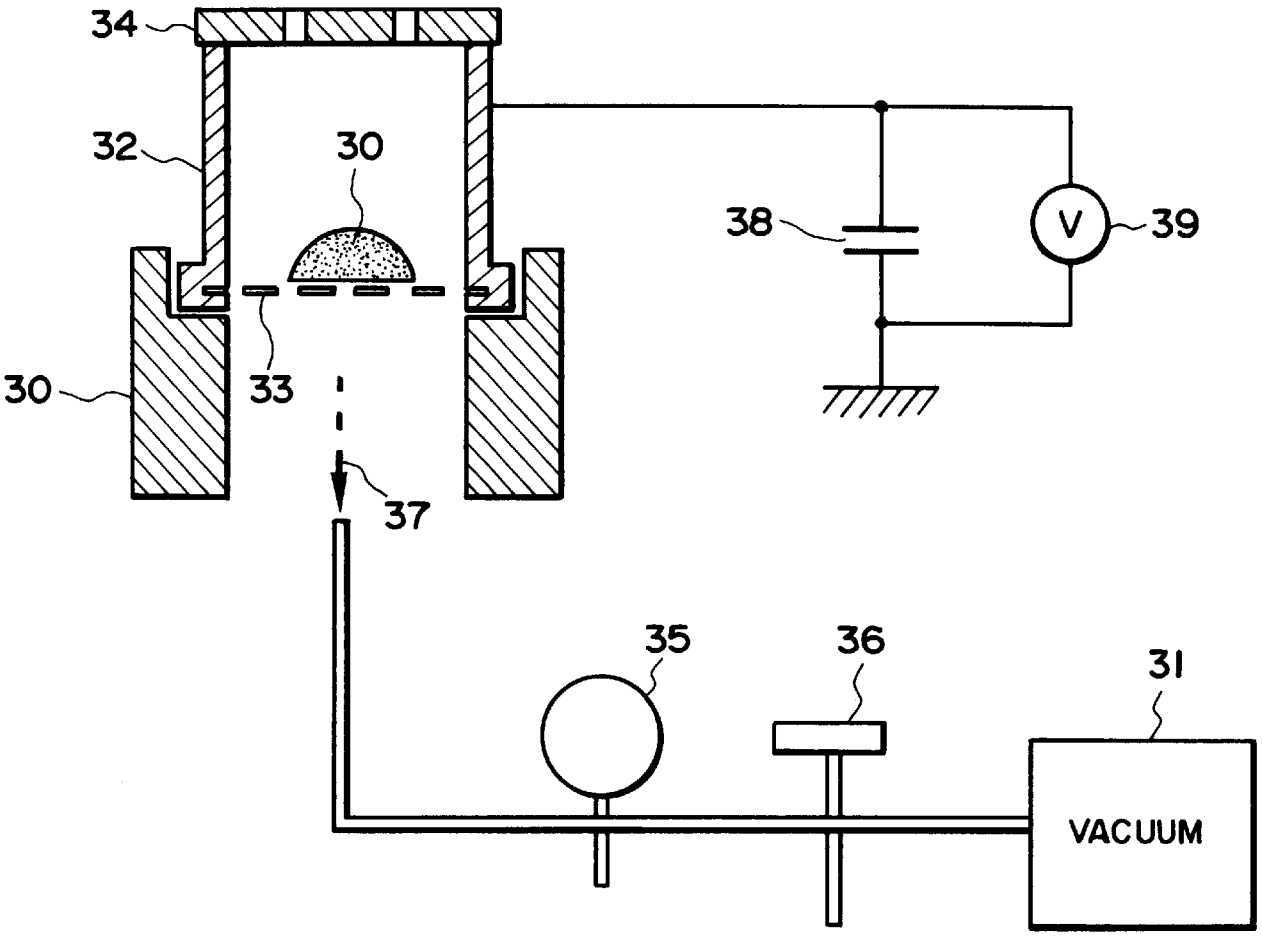
FIG. 3 is an illustration of measuring the toner triboelectric charge or triboelectric charging ability of magnetic particles.

An outline of the measurement apparatus is illustrated in FIG. 3. Referring to FIG. 3, in an environment of 23° C. and 60% RH (relative humidity), a mixture 30 of 0.040 kg of magnetic particles and 0.0028 kg of a toner is placed in a polyethylene bottle (not shown) of 50–100 ml in volume, and the bottle is shaken 150 times by hands. Then, 0.0005 kg of the mixture 30 is placed in a metal measurement vessel 40 provided with a 500-mesh screen 33 at the bottom and is covered with a metal lid 34. At this time, the entire measurement vessel 32 is weighed at $W_1$ kg. Then, the mixture 30 is sucked through an aspirator 30 (of which at least a portion contacting the vessel 32 is composed of an insulating material), and a suction port 37 connected to a vacuum system 31 while adjusting a control valve 36 to provide a pressure of 250 mmAq. at a vacuum gauge 35. In this state, the toner is sufficiently sucked for 3 minutes (possibly together with a minor proportion of the magnetic particles). Thereafter, a potential meter 39 connected via a capacitor 38 having a capacitance of C (mF) is read at a potential of V (volts). After the suction, the entire measurement vessel is weighed at $W_2$ (kg). In the case where substantially no magnetic particles are passed through the screen 33, the triboelectric charge Q' (mC/kg) of the toner is calculated from the measured values according to the following equation:

$$Q' \text{ (mC/kg)} = C\ V/(W_1 - W_2).$$

In the case of using the charging magnetic particles of the present invention having an average particle size of, e.g., 40 $\mu$m or below, a substantial proportion thereof can pass through even the 500-mesh screen 33. In this case, the triboelectric charge Q (mC/kg) of the toner is calculated according to the following equation on the assumption that the charge of the portion of the magnetic particles having passed through the screen 33 is canceled with the triboelectric charge of the toner:

$$Q \text{ (mC/kg)} = C\ V/(M_3.M_2/(M_1+M_2)],$$

wherein $M_1$ and $M_2$ denote the weights (0.040 kg and 0.0028 kg) of the magnetic particles and the toner in the initially prepared mixture, and $M_3$ denotes the weight (0.0005 kg) of the portion of the mixture 30 placed in the measurement vessel 32.

In the electrophotographic apparatus of the present invention, a magnetic brush formed of the magnetic particles described heretofore is used as a charging member so as to constitute a part of the charging means (charging device), and the charging means may suitably be formed by coating an electroconductive sleeve 16 enclosing therein a magnet (a magnetic particle-retention number) uniformly with such magnetic particles 15 as illustrated in FIG. 1. The magnetic particle-retention member 16 may suitably be disposed with a minimum gap of 0.3–2.0 mm from a photosensitive member 12. If the gap is smaller than 0.3 mm, an electrical leakage can occur between an electroconductive portion of the retention member 16 and the photosensitive member, thereby causing damage to the photosensitive member, while it depends on the level of voltage applied to the member 16.

The charging magnetic brush 15 can move in an identical or a reverse direction with respect to the moving direction of the photosensitive member 12 at their position of contact, but a reverse direction (as shown in FIG. 1) may be preferred in view of the performances of taking in and uniformly charging the transfer residual toner.

The charging magnetic particles 15 may preferably be held on the retention member 16 at a rate of 50–500 mg/cm$^2$, and further preferably 100–300 mg/cm$^2$, so as to exhibit a particularly stable charging ability.

In the case of the injection charging process, the charging bias voltage can be composed of a DC component alone, but some improvement in image quality may be attained if some AC component is superposed on the DC component. The DC component may have a voltage which may be almost equal to or slightly higher than a desired surface potential of the photosensitive member. While depending on the charging or image forming process speed, the AC component may preferably have a frequency of about 100 Hz to 10 kHz and a peak-to-peak voltage of at most about 1000 volts. In excess of 1000 volts, a potential can occur on the photosensitive member in response to the applied voltage, thereby resulting in potential waving on the latent image surface leading to fog or a lower image density.

In the discharge-based contact charging system, the charging bias voltage preferably comprises an AC-superposed DC voltage. In the case where a DC voltage alone is applied, the absolute value of the DC voltage has to be substantially higher than the desired surface potential of the photosensitive member. The AC component may preferably have a frequency of about 100 Hz–10 kHz and a peak-to-peak voltage of about 1000 volts, at least two times the discharge initiation voltage, while it can depend on the process speed. Such a high AC voltage is preferred in order to attain a sufficient smoothing effect between the magnetic brush and the photosensitive member surface. The AC component may have a waveform of sign, rectangular or sawteeth. In this case, the DC component may have a voltage which is almost equal to the desired surface potential of the photosensitive member.

It is possible to retain an excessive amount of the charging magnetic particles and circulate the magnetic particles in the charging device.

A preferred embodiment of the electrophotographic photosensitive member used in the present invention will now be described, wherein the following layers may be included preferably in an order appearing hereinafter.

An electroconductive support is generally used, which may comprise a metal, such as aluminum or stainless steel, an alloy, such as an aluminum alloy or indium oxide-tin oxide alloy, a plastic coated with a layer of such a metal or alloy, paper or a plastic sheet impregnated with electroconductive particles, or a plastic comprising an electroconductive polymer in the shape of a cylinder or a sheet.

On the electroconductive support, it is possible to dispose an undercoating layer for the purpose of providing an improved adhesion and applicability of the photosensitive layer, protection of the support, coverage of defects on the support, an improved charge injection from the support, and protection of the photosensitive layer from electrical breakage. The undercoating layer may comprise polyvinyl alcohol, poly-N-vinylimidazole, polyethylene oxide, ethyl cellulose, methyl cellulose, nitrocellulose, ethylene-acrylic acid copolymer, polyvinyl butyral, phenolic resin, casein, polyamide, copolymer nylon, glue, gelatin, polyurethane, or aluminum oxide. The thickness may ordinarily be about 0.1–10 $\mu$m, and preferably about 0.1–3 $\mu$m.

A photosensitive layer may be formed in a single layer structure containing both a charge generation substance and a charge transporting substance in a single layer, or a laminate structure including a charge generation layer containing a charge generation substance and a charge transport layer containing a charge transporting substance. The laminate structure is preferred in view of electrophotographic performance.

The charge generation layer may comprise a charge generation substance, examples of which may include: organic substances, such as azo pigments, phthalocyanine pigments, indigo pigments, perylene pigments, polycyclic quinone pigments, pyrylium salts, thiopyrilium salts, and triphenylmethane dyes; and inorganic substances, such as selenium and amorphous silicon, in the form of a dispersion in a film of an appropriate binder resin or a vapor deposition film thereof. The binder resin may be selected from a wide variety of resins, examples of which may include polycarbonate resin, polyester resin, polyvinyl butyral resin, polystyrene resin, acrylic resin, methacrylic resin, phenolic resin, silicone resin, epoxy resin, and vinyl acetate resin. The binder resin may be contained in an amount of at most 80 wt. %, and preferably 0–40 wt. %, of the charge generation layer. The charge generation layer may preferably have a thickness of at most 5 $\mu$m, preferably 0.05–2 $\mu$m.

The charge transport layer has the function of receiving charge carriers from the charge generation layer and transporting the carriers under an electric field. The charge transport layer may be formed by dissolving a charge transporting substance optionally together with a binder resin in an appropriate solvent to form a coating liquid and applying the coating liquid. The thickness may ordinarily be 0.5–40 $\mu$m. Examples of the charge transporting substance may include: polycyclic aromatic compounds having in them a main chain or side chain a structure such as biphenylene, anthracene, pyrene or phenanthrene; nitrogen-containing cyclic compounds, such as indole, carbazole, oxadiazole, and pyrazoline; hydrazones, styryl compounds, selenium, selenium-tellurium, amorphous silicon and cadmium sulfide.

Examples of the binder resin for dissolving or dispersing therein the charge transporting substance may include: resins, such as polycarbonate resin, polyester resin, polystyrene resin, acrylic resins, and polyamide resins; and organic photoconductive polymers, such as poly-N-vinylcarbozole and polyvinyl-anthracene.

A single layer-structured photosensitive layer may be formed by applying a coating liquid containing the above-mentioned charge generation substance, charge transporting substance, and binder resin.

In the present invention, it is preferred to use a photosensitive member having a charge-injection layer as a layer most distant from the support, i.e., a surface layer. The charge-injection layer may preferably have a volume resistivity of $1\times10^8$ ohm.cm–$1\times10^{15}$ ohm.cm so as to have a sufficient chargeability and to avoid image flow. It is particularly preferred to have a volume resistivity of $1\times10^{10}$ ohm.cm–$1\times10^{15}$ ohm.cm, in order to avoid the image flow, and further preferably $1\times10^{10}$–$1\times10^{13}$ ohm.cm in view of environmental change. Below $1\times10^8$ ohm.cm, the charge carrier is not retained along the surface in a high-humidity environment, thus being liable to cause image flow. Above $1\times10^{15}$ ohm.cm, charge cannot be sufficiently injected from the charging member and retained, thus being liable to cause a charging failure. By disposing a functional layer at the photosensitive member surface, charge injected from the charging member is retained therein, and further the change is allowed to flow to the support of the photosensitive member at the time of light exposure to reduce the residual potential. Further, by using the charging member and the photosensitive member according to the present invention, the charge initiation voltage Vth can be lowered and the photosensitive member charge potential can be converged to a value which is almost 90% or above the DC component of the applied voltage to the charging member, thereby realizing the injection charging.

For example, under ordinary charging condition (e.g., under the application of a DC voltage of 100–2000 volts and a process speed of at most 1000 mm/min), it has become possible to effect an injection charging such that the photosensitive member having a charge-injection layer is charged to a potential which is at least 80%, and preferably at least 90%, of a voltage applied to the charging member. This is a substantially larger value than, e.g., about 30%, i.e., a potential of about 200 volts (absolute) in response to an applied DC voltage of 700 volts (absolute), in the case of conventional contact charging based on discharging.

The charge injection layer may be formed as an inorganic layer, such as a metal vapor-deposition layer, or a resin layer containing electroconductive particles dispersed therein. Such an inorganic layer may be formed by vapor deposition, and a conductive particles-dispersed resin layer may be formed by an appropriate coating method, such as dipping, spraying, roller coating or beam coating. Further, the charge injection layer can also be formed with a mixture or copolymer of an insulating binder resin and a light-transmissive resin having a high ion-conductivity, or a photoconductive resin having a medium resistivity alone. In order to constitute the conductive particle-dispersed resin layer, the electroconductive particles may preferably be added in an amount of 2–190 wt. % of the binder resin. Below 2 wt. %, a desired volume resistivity cannot be readily obtained and, above 190 wt. %, the charge injection layer is caused to have a lower film strength and is therefore liable to be worn out by scraping, thus resulting in a short life for the photosensitive member.

The charge injection layer may comprise a binder resin, examples of which may include; polyester, polycarbonate, acrylic resin, epoxy resin, phenolic resin, and curing agents of these resins. These may be used singly or in combination of two or more species. Further, in case of dispersing a large amount of electroconductive particles, it is preferred to use a reactive monomer or reactive oligomer with electroconductive particles dispersed therein and, after the application thereof onto the photosensitive member surface, to cure the applied resin under exposure to light or heat. Further, in case where the photosensitive layer comprises amorphous silicon, it is preferred to dispose a charge injection layer comprising SiC.

The electroconductive particles dispersed in the binder resin of the charge injection layer may, for example, comprise a metal or a metal oxide. It is preferred to use ultra-fine particles of zinc oxide, titanium oxide, tin oxide, antimony oxide, indium oxide, bismuth oxide, tin oxide-coated titanium oxide, tin-coated indium oxide, antimony-coated tin oxide, and zirconium oxide. These may be used singly or in a combination of two or more species. In the case of dispersing particles in the charge injection layer, the particles are required to have a particle size which is smaller than the wavelength of light incident thereto, so as to avoid scattering of the incident light with the dispersed particles. Accordingly, the electroconductive particles, and other particles, if any, dispersed in the protective layer may preferably have a particle size of at most 0.5 $\mu$m.

The charge injection layer may preferably further contain lubricant particles, so that a contact (charging) nip between the photosensitive member and the charging member at the time of charging becomes enlarged thereby due to a lowered friction therebetween, thus providing improved charging performance. The lubricant powder may preferably comprise a fluorine-containing resin, silicone resin or polyolefin resin having a low critical surface tension. A fluorine-containing resin, particularly polytetrafluoroethylene (PTFE) resin is further preferred. In this instance, the lubricant powder may be added in 2–50 wt. %, preferably 5–40 wt. %, of the binder resin. Below 2 wt. %, the lubricant is insufficient, so that the improvement in charging performance is insufficient. Above 50 wt. %, the image resolution and the sensitivity of the photosensitive member are remarkably lowered.

Examples of the fluorine-containing resin may include: polytetrafluoroethylene, polychlorotrifluoroethylene, polyvinylidene fluoride, polydichlorodifluoroethylene, tetrafluoroethylene-perfluoroalkyl vinyl ether copolymer, tetrafluoroethylene-hexafluoropropylene copolymer, tetrafluoroethylene-ethylene copolymer, and tetrafluoroethylene-hexafluoropropylene-perfluoroalkyl vinyl ether copolymer. These resins may be used singly or in combination of two or more species. These fluorine-containing resins may be commercially available in a particulate form. The resins may have a number-average molecular weight of $0.3\times10^4$–$5\times10^6$ and may be used in a particulate form having particle sizes of 0.05–2.0 $\mu$m.

The charge injection layer may preferably have a thickness of 0.1–10 $\mu$m, particularly 1–7 $\mu$m. If the thickness is below 0.1 $\mu$m, the layer is liable to show insufficient resistant to minute scars, thus resulting in image defects due to injection failure, and in excess of 10 $\mu$m, the resultant images are liable to be disordered due to the diffusion of injected charge.

In the electrophotographic apparatus according to the present invention, the exposure means may comprise known means, such as a laser or an LED.

The developing means are not particularly limited, but as the image forming apparatus according to the present invention does not include a separate cleaning means, a developing means according to the reversal development mode is preferred and may preferably have a structure wherein the developer contacts the photosensitive member. Examples of the preferred developing method include a contact two-component developing method and a contact monocomponent developing method. This is because, in case where the developer and the transfer residual toner contact each other on the photosensitive member, the transfer residual toner can be effectively recovered by the developing means due to the frictional force in addition to the electrostatic force. The developing bias voltage may preferably have a DC component which exhibits a potential between a black image portion (an exposed portion in the case of reversal development) and a white image portion.

The transfer means may comprise a known form, such as a corona charger, a roller or belt charger, etc.

In the present invention, the electrophotographic photosensitive member and the charging device, and optionally the developing means, may be integrally supported to form an integral unit (cartridge), (e.g. a cartridge 20 in the embodiment shown in FIG. 1), which can be detachably mountable to a main assembly. Unlike in the embodiment shown in FIG. 1, the developing means can also be formulated into a cartridge separate from a cartridge including the electrophotographic photosensitive member and the charging device.

In the present invention, it is unnecessary to change the bias voltage applied to the charger (charging device) for conveying and transferring the transfer residual toner once recovered in the charger via the photosensitive member surface to the developing means for recovery and re-utilization. However, e.g., in the case of paper jamming or in the case of continually forming images of a high image proportion, the amount of transfer residual toner contained in the charger can increase to an extraordinarily high level. In such a case, it is possible to transfer the recovered transfer residual toner from the charger to the developing device in a period of no image formation on the photosensitive member during the operation of the electrophotographic apparatus. The period of no image formation refers to, e.g., a period of pre-rotation, a period of post-rotation, a period of successive sheet supplies of transfer-receiving material, etc. In that case, the charging bias voltage can be changed to a level promoting the transfer of transfer residual toner from the charger to the developing device, e.g., by reducing the peak-to-peak voltage of the AC component, by applying only the DC component, or by reducing the AC effective value by changing not the peak-to-peak voltage but the waveform.

The toner used in the present invention is not particularly limited but may preferably be one exhibiting a high transfer efficiency so as to obviate the toner scattering. More specifically, if the amount of the transfer residual toner contacting the magnetic brush is reduced, the entire amount of the toner possibly causing the toner scattering is reduced, thereby exhibiting a large effect of combination with the electrophotographic apparatus of the present invention. A toner tends to show a good transferability if it has shape factors SF-1 of 100–160 and SF-2 of 100–140. It is particularly preferred that SF-1 is 100–140 and SF-2 is 100–140. A toner prepared by the polymerization process and showing shape factors within the above-described ranges particularly shows a good transfer efficiency and is preferred.

The shape factors SF-1 and SF-2 referred to herein are based on values measured in the following manner. Sample particles are observed through a field-emission scanning electron microscope ("FE-SEM S-800", available from Hitachi Seisakusho K.K.) at a magnification of 500, and 100 images of toner particles having a particle size (diameter) of at least 2 μm are sampled at random. The image data are inputted into an image analyzer ("Luzex 3", available from Nireco K.K.) to obtain averages of shape factors SF-1 and SF-2 based on the following equations:

$$SF\text{-}1=[(MXLNG)^2/AREA]\times(\pi/4)\times 100,$$

$$SF\text{-}2=[(PERI)^2/AREA]\times(1/4\pi)\times 100,$$

wherein MXLNG denotes the maximum length of a sample particle, PERI denotes the perimeter of a sample particle, and AREA denotes the projection area of the sample particle.

The shape factor SF-1 represents the roundness of toner particles, and the shape factor SF-2 represents the roughness of toner particles. If both factors are closer to 100, the particles have shapes closer to true spheres.

The toner used in the present invention may preferably have a weight-average particle size of 1–9 μm, and more preferably 2–8 μm, and contain an external additive in the form of fine particles having a weight-average particle size of 0.012–0.4 μm so as to provide a good combination of forming high-quality images and good continuous image forming performance. It is further preferred that the external additive has an average particle size of 0.02–0.3 μm, and further preferably 0.03–0.2 μm. This is because the friction between the magnetic particles are much severer in the charging magnetic brush than in the developing magnetic brush but the external additive present on the transfer residual toner in the charging magnetic brush can effectively reduce the abrasion of the toner due to friction with the magnetic particles. In a cleaner system as in the present invention, it is particularly preferred to prevent the deterioration of the transfer residual toner for re-utilization. If the external addition particle size is below 0.012 μm, it become difficult to attain the above-mentioned effect, and the separation of the toner from the charging member becomes difficult to be accumulated in the charging member. On the other hand, in excess of 0.4 μm, the external additive is liable to fall off the toner, so that it becomes difficult to attain the above-mentioned effect, and the toner flowability is liable to be inferior, thus resulting in non-uniform toner charges.

The external additive for the toner may not be particularly limited if it has a particle size of 0.0012–0.4 μm as described above, but may preferably comprise hydrophobized inorganic fine powder, such as that of silica, titania, zirconia or alumina in view of the stable chargeability and whiteness. Further, titania or alumina, particularly amorphous alumina, is preferred in view of the flowability and environmental stability of the resultant toner, and anatase-form titania having a medium level of resistivity is further preferred so as not to hinder the injection charging performance.

The hydrophobization agent may comprise, for example, a coupling agent, such as silane coupling agent, titanate coupling agent or aluminum coupling agent, or an oil, such as silicone oil, fluorine-containing oil or various modified oils.

Among the above-mentioned hydrophobization agents, a coupling agent is particularly preferred in view of the stable chargeability and flowability of the resultant toner.

Accordingly, as the external additive for the toner used in the present invention, it is particularly preferred to use anatase-form titanium oxide fine particles surface-treated while hydrolyzing a coupling agent in view of the charging stability and flowability of the resultant toner.

The hydrophobized inorganic fine powder may preferably have, a hydrophobicity of 20–80%, and more preferably 40–80%.

If the hydrophobicity of the inorganic fine powder is below 20%, the resultant toner is liable to have a remarkably lower chargeability when left standing for a long period in a high humidity environment, thus requiring a mechanism for promoting the chargeability in the apparatus which results in a complicated apparatus. If the hydrophobicity exceeds 80%, the chargeability control of the inorganic fine powder per se becomes difficult, so that the toner is liable to be excessively charged in a low humidity environment.

A method for measuring the hydrophobicity will be described later.

The toner used in the present invention may preferably have a weight-average particle size of 1–9 μm, and more preferably 2–8 μm, so as to provide high-quality images and good continuous image forming performance in combination.

If the particle size is below 1 μm, the toner exhibits a lower mixability with carrier particles, thus being liable to cause difficulties, such as toner scattering and if the particle size is fog, and in excess of 9 μm, the toner is liable to cause a lowering in reproducibility of minute dot latent images and scattering at the time of transfer and processing of the transfer residual toner in the charging device, thus hindering the high-quality image production.

The toner used in the present invention may contain a known dye or pigment as a colorant, examples of which may include: Phthalocyanine Blue, Indanthrene Blue, Peacock Blue, Permanent Red, Lake Red, Rhodamine Lake, Hansa Yellow, Permanent Yellow and Benzidine Yellow. The colorant may preferably be contained in a proportion of at most 12 wt. parts, and more preferably 2 10 wt. parts, in 100 wt. parts of the toner, so as to provide a good transparency of an OHP film.

The toner used in the present invention may be blended with or contain optional additives to the extent that they do not adversely affect toner performances. Examples of such optional additives may include: lubricants, such as polytetrafluoroethylene, zinc stearate and polyvinylidene fluoride; fixing aids, such as low-molecular weight polyethylene and low-molecular weight polypropylene; and transfer aids, such as silica particles, silicone resin particles, alumina particles and organic resin particles.

The toner used in the present invention may for example be prepared through a process wherein the toner ingredients are well melt-kneaded through a hot kneading means, such as heated rollers, a kneader or an extruder, followed by mechanical pulverization and classification; a process wherein toner ingredients such as a colorant are dispersed in a binder resin solution, and the resultant dispersion is spray-dried; and a polymerization toner production process wherein prescribed additives as toner constituents are mixed with a polymerizable monomer for providing a binder resin, and the mixture dispersed in an aqueous or non-aqueous dispersion medium and polymerized therein to provide toner particles.

The binder resin constituting the toner used in the present invention may comprise various resins, examples of which may include: polystyrene, styrene copolymers such as styrene-butadiene copolymer and styrene-acrylic copolymers, polyethylene, ethylene copolymers such as ethylene-vinyl acetate copolymer and ethylene-vinyl alcohol copolymer, phenolic resin, epoxy resin, allyl phthalate resin, polyamide resin, polyester resin and maleic acid resins. The production processes for these resins are not particularly limited.

In order to prepare the toner used in the present invention, it is particularly preferred to adopt the suspension polymerization process under normal pressure or elevated pressure wherein fine toner particles having an weight-average particle size of 4–8 $\mu$m can be easily formed at a sharp particle size distribution. It is particular preferred to produced toner particles have a so-called core/shell structure wherein a core material rich in a low-softening point substance, such as wax, is enclosed with an outer shell through such a suspension polymerization process. More specifically, such toner particles having a so-called core/shell structure and containing a low-softening point substance enclosed within an outer shell resin may, for example be produced by adding to a principal monomer a low-softening point substance having a polarity lower than that of the principal monomer, and also a minor amount of a resin or monomer having a larger polarity to form a polymerizable monomer mixture, and subjecting the polymerizable monomer mixture to suspension polymerization in an aqueous medium. In the suspension polymerization process, it is possible to control the average particle size and particle size distribution of the resultant toner particles by changing the species and amount of a hardly water-soluble inorganic salt or a dispersing agent functioning as a protective colloid; by controlling the mechanical process conditions, including stirring conditions such as the rotor peripheral speed, the number of passes and the stirring blade shape, and the vessel shape; and/or by controlling the weight percentage of solid matter in the aqueous dispersion medium.

The cross-section of toner particles having such a core/shell structure may be observed in the following manner. Sample toner particles are sufficiently dispersed in a cold-setting epoxy resin, which is then hardened for 2 days at 40° C. The hardened product is dyed with triruthenium tetroxide optionally together with triosmium tetroxide and sliced into thin flakes by a microtome having a diamond cutter. The resultant thin flake sample is observed through a transmission electron microscope to confirm a sectional structure of toner particles. The dyeing with triruthenium tetroxide may preferably be used in order to provide a contrast between the low-softening point substance (wax) and the outer resin by utilizing a difference in crystallinity therebetween.

The binder resin (preferably constituting the outer shell resin of the core/shell structure) may comprise styrene-(meth)acrylic copolymers, polyester resin, epoxy resin or styrene-butadiene copolymer. In the polymerization process for toner production, corresponding monomers for the above resins may be used. Such monomers may preferably comprise vinyl monomers, examples of which may include: styrene monomers, such as styrene, o-, m- or p-methylstyrene, and m- or p-ethylstyrene; (meth)acrylate ester monomers, such as methyl (meth)acrylate, ethyl (meth) acrylate, propyl (meth)acrylate, butyl (meth)acrylate, octyl (meth)acrylate, dodecyl (meth)acrylate, stearyl (meth) acrylate, behanyl (meth)acrylate,, 2-ethylhexyl (meth) acrylate, methylaminoethyl (meth)acrylate, and diethylaminoethyl (meth)acrylate; butadiene, isoprene, cyclohexene, (meth)acrylonitrile, and acrylamide.

These monomers may be used singly or in mixtures so as to provide a polymer giving a theoretical glass transition temperature (Tg) described in Polymer Handbook, Second Edition, III, pp. 139–192 (John Wiley & Sons) of 40–75° C. If the theoretical glass transition temperature is below 40° C., the resultant toner is liable to suffer from difficulties with respect to storage stability and continuous image forming stability. On the other hand, in excess of 75° C., the toner shows an increased fixable temperature. This is particularly undesirable for color toners for forming full-color images, as the color mixability of the respective color toners is lowered to result in inferior color reproducibility and OHP images with lowered transparency.

The molecular weight (distribution) of a binder resin (or outer shell resin) may be measured by gel permeation chromatography (GPC). In a specific measurement method, a toner comprising such a binder resin and also a low-softening point substance is subjected to 20 hours of extraction with toluene by means of a Soxhlet extractor, and the toluene is distilled off from the resultant extract liquid by a rotary evaporator. The residue is sufficiently washed with an organic solvent (such as chloroform) capable of dissolving the low-softening point substance but not dissolving the binder resin. The residual resin is then dissolved in tetrahydrofuran (THF) and the resultant solution is filtrated through a solvent-resistant membrane filter having a pore size (diameter) of 0.3 $\mu$m to prepare a sample solution, which is then subjected to GPC by using, e.g., a GPC apparatus (e.g., "GPC-150C", available from Waters Co.). The sample solution may be prepared so as to provide a binder resin concentration of 0.05–0.6 wt. %. The sample solution may be injected in an amount of 50–200 $\mu$l. The columns may comprise a series of, e.g., A-801, 802, 803, 804, 805, 806 and 807 available from Showa Denko K.K., and a calibration cure for providing a molecular weight distribution may be prepared by using standard polystyrenes. The binder resin (outer shell resin) may preferably have a number-average molecular weight (Mn) of $5\times10^3$–$10^6$ and a ratio (Mw/Mn)

between a weight-average molecular weight and the number-average molecular weight (Mn) in the range of 2–100.

In the case of producing toner particles having a core/shell structure preferably used in the present invention, as the low-softening point substance is enclosed within the binder resin constituting the outer shell, it is particularly preferred to incorporate a further polar resin in the binder resin. Preferred examples of such a polar resin may include styrene-(meth)acrylic acid copolymer, maleic acid copolymer, saturated polyester resin and epoxy resin. The polar resin may preferably be free from an unsaturated group reactive with the other binder resin or monomers therefor. If the polar resin has an unsaturated group, the polar resin can cause a crosslinking reaction with the monomers for the binder resin to result in a binder resin fraction having a very high molecular weight, thus providing a toner unsuitable as a color toner constituting a full-color toner system expected to show good color mixability.

The toner particles used in the present invention can be further provided with an outermost shell resin, which may preferably be designed to have a glass transition temperature higher than that of the binder resin and may preferably be crosslinked to an extent not adversely affecting the fixability of the resultant toner, so as to provide a further improved anti-blocking property. The outermost shell resin layer may preferably comprise a polar resin or contain a charge control agent so as to provide an improved chargeability.

Such an outermost shell resin layer may, for example, be produced through the methods enumerated below.

(1) In a later period of or after the polymerization process for toner production, a monomer composition comprising a monomer and optional additives, such as a polar resin, a charge control agent and a crosslinking agent, added thereto as desired for dissolution or dispersion, is added to the polymerization system so as to be adsorbed onto the already formed polymerizate particles and then polymerized in the presence of a polymerization initiator.

(2) Emulsion polymerizate particles or soap-free polymerizate particles formed from a monomer composition comprising a monomer and optional additives, such as a polar resin, a charge control agent and a crosslinking agent, added thereto as desired, are added to the suspension polymerization system, and agglomerated to stick onto the suspension polymerizate particles, if necessary under heating.

(3) Emulsion polymerizate particles or soap-free polymerizate particles formed from a monomer composition comprising a monomer and optional additives, such as a polar resin, a charge control agent and a crosslinking agent, added thereto as desired, are caused to mechanically stick onto already-formed toner particles in a dry system.

As for a magnetic carrier for constituting a two-component type developer used in the present invention, it is undesirable to use iron powder, copper-zinc-ferrite or nickel-zinc-ferrite carrier suitably used heretofore as it is, since such a carrier is liable to disturb an electrostatic latent image formed on the electrophotographic photosensitive member. For this reason, it is preferred to use a magnetic carrier (or developer carrier) having a volume resistivity Da (or Rp) that is larger than a volume resistivity Sa (or $R_{SL}$) of the surface layer of the photosensitive member (i.e., Sa<Da). On the other hand, in the case of Sa≧Da similarly as in the case of a conventional carrier as mentioned above, the latent image potential is liable to be disordered by rubbing with the developer carrier especially under the application of a developing bias voltage since some voltage can be injected to the photosensitive member due to the influence of the developing bias.

Such a preferred developer carrier may be provided as a resin-coated carrier having a carrier 20 core comprising a ferrite represented by the following formula (I), or a magnetite ($Fe_3O_4$)-containing resinous carrier prepared by suspension polymerization:

$$(Fe_2O_3)_x(A)_y(B)_z \quad (1),$$

wherein A denotes MgO, $Ag_2O$ or a mixture thereof; B denotes $Li_2O$, MnO, CaO, SrO, $Al_2O_3$, $SiO_2$ or a mixture thereof; and x, y and z are numbers representing the weight ratios and satisfying the conditions of:

$0.2 \leqq x \leqq 0.95$, $0.05 \leqq y 0.3$, $0 < z \leqq 0.795$, and $x+y+z \leqq 1$.

On the other hand, the polymerization resinous carrier contains $Fe_3O_4$ and may preferably further contain $Fe_2O_3$, $Al_2O_3$, $SiO_2$, CaO, SrO, MgO, MnO, or a mixture of these oxides. It is preferred that $Fe_3O_4$ occupies 20–80 wt. % of the total oxides.

In the case where x in the formula (I) is below 0.2 or $Fe_3O_4$ is below 20 wt. % in the polymerization resinous carrier, the resultant carrier is caused to have lower magnetic properties, thus being liable to cause carrier scattering or damage the photosensitive member surface. On the other hand, if x exceeds 0.95 or $Fe_3O_4$ exceeds 80 wt. %, the carrier (or carrier core) is liable to show a low resistivity, so that a resin-rich surface has to be formed, thus being liable to cause coalescence of carrier particles.

Further, in the ferrite core carrier, if y<0.005, it becomes difficult to obtain appropriate magnetic properties, and if y>0.3, it becomes difficult to form a uniform carrier surface or spherical carrier particles in some cases. Further, if z=0 (i.e., no (B) component), it becomes difficult to obtain carrier particles having a sharp particle size distribution, it is liable to damage the photosensitive member surface with ultrafine carrier powder, or the carrier production becomes difficult due to severe coalescence during the sintering. If z>0.795, the carrier is caused to have low magnetic properties, so that the carrier scattering is liable to be intense.

In the formula (I), B denotes $LiO_2$, MnO, CaO, SrO, $Al_2O_3$ or $SiO_2$. Among these, MnO, CaO, $SiO_2$ and $Al_2O_3$ are prepared because of little resistivity change even under high voltage application, and particularly MnO and CaO are preferred because of good compatibility with replenished toner.

The polymerization resinous carrier may be easily formed in spherical particles and may have a sharp particle size distribution. Accordingly, the polymerization resinous carrier is advantageous in preventing carrier attachment onto the photosensitive member even if it is formed in smaller particles than ordinary ferrite carriers. Accordingly, the polymerization resinous carrier may have an average particle size ($D_{V50}$%) of 10–45 μm, preferably 15–40 μm.

The magnetic carrier core particles used in the present invention may be coated with a resin, which may preferably comprise crosslinked silicone resin, fluorine-containing resin or acrylic resin.

The formation of a resin coating layer on the magnetic carrier core particles may be performed by a method wherein a resin composition is dissolved in an appropriate solvent, and the carrier core particles are dipped in the resultant solution, followed by solvent removal, drying and high-temperature baking; a method wherein the magnetic carrier core particles are floated in a fluidized system, and a solution of the resin composition is sprayed thereto, followed by drying and high-temperature baking; or a method wherein the magnetic carrier core particles are simply blended with a resin composition in a powder state or in an aqueous emulsion form.

In a preferred coating mode, a mixture solvent formed by adding 0.1–5 wt. parts, and preferably 0.3–3 wt. parts, of water into 100 wt. parts of a solvent containing at least 5 wt. %, preferably at least 20 wt. %, of a polar solvent, such as a ketone or an alcohol, is used for coating with a reactive silicone resin intimately adhering onto magnetic carrier core particles. If the water is below 0.1 wt. part, the respective silicone resin cannot be sufficiently hydrolyzed, so that it becomes difficult to form a thin and uniform coating on the surface of the magnetic carrier core particles. In excess of 5 wt. parts, the reaction control becomes difficult to result in a rather weak coating strength.

In the case of preparing a two-component type developer by blending a carrier and a toner, they may be blended to provide a two-component type developer having a toner concentration of 1–15 wt. %, preferably 3–12 wt. %, and further preferably 5–10 wt. %, so as to provide a good developing performance. At a toner concentration of below 1 wt. %, the image density is liable to be lowered. A toner concentration exceeding 15 wt. % causes increased fog and toner scattering in the apparatus, and can shorten the life of the two-component developer in some cases.

On the other hand, in the case of using a mono-component type developer, the above-mentioned function of the carrier is entrusted to a developer-or toner-carrying member.

More specifically, an electrostatic latent image formed on a photosensitive member having a surface layer volume resistivity Sb may preferably be developed with a layer of mono-component type developer carried on a developer-carrying member showing a surface layer volume resistivity Db satisfying $Sb<Db$. In the case of $Sa \geqq Db$, the electrostatic latent image is liable to be disordered for the same as in the above-mentioned case of rubbing with the developer carrier.

Figure 4:
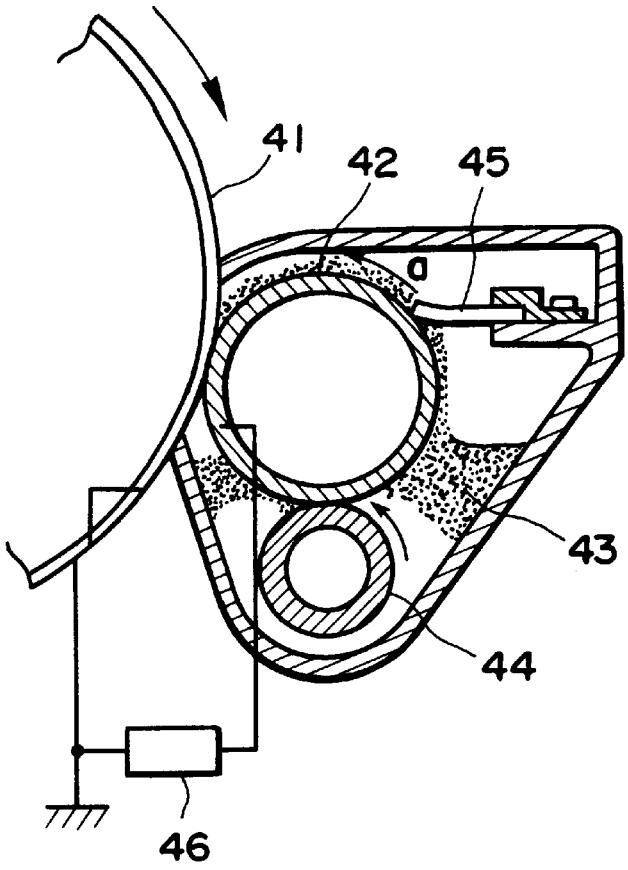
FIG. 4 is an illustration a non-magnetic mono-component type developing device.

The process will be described more specifically. FIG. 4 is a sectional illustration of an embodiment of a developing device using such a mono-component type developer. An electrostatic latent image may be formed on an electrophotographic photosensitive member 41 similarly as in the system described with reference to FIG. 1. The developing device includes a developer-carrying member 42 which may suitably comprise a sleeve surfaced with an elastomer, such as silicone rubber, urethane rubber, styrene-butadiene rubber or polyamide resin. The surface layer can further contain an organic resin, or organic or inorganic fine particles dispersed therein, as desired, in order to provide a suitable volume resistivity.

A nonmagnetic monocomponent toner 43 is stored in a vessel, and supplied to the developer-carrying member 42 by a supply roller 44, which also functions to peel off the toner carried on the developer-carrying member 42 after the developing. The toner supplied to the developer-carrying member 42 is uniformly applied into a thin layer by a developer coating blade 45, and is used for developing the electrostatic latent image formed on the photosensitive member 41 while contacting the photosensitive member 41 under the application of a developing bias voltage from a voltage supply 46.

The developer coating blade 45 may be abutted against the developer-carrying member 46 at an abutting linear pressure of 3–250 g/cm, and preferably 10–120 g/cm. If the pressure is below 3 g/cm, the uniform toner application becomes difficult, thus resulting in a broad toner charge distribution leading to fog or scattering. If the abutting pressure exceeds 250 g/cm, because of a large pressure applied to the toner, the toner particles are liable to agglomerate with each other or be pulverized. By adjusting the abutting pressure within the range of 3–250 g/cm, the agglomerates of toner particles liable to occur for a small particle size toner can be disintegrated and the toner charge can be increased quickly from the start-up of the apparatus. The developer-coating blade may preferably comprise a material having a position in a triboelectric chargeability series suitable for charging the toner to a desired polarity. In the present invention, the developer-carrying member may suitably comprise, e.g., silicone rubber, urethane rubber or styrene-butadiene rubber. It is possible to further coat the blade with a polyamide resin, etc. It is preferred to use electroconductive rubber for preventing the toner from being excessively charged.

In the non-magnetic monocomponent developing system, the toner layer on the developer-carrying member can be formed in a thickness smaller than the minimum gap between the developer-carrying member and the photosensitive member at the developing region while applying an alternating AC voltage across the gap so as to attain a sufficient image density. In the present invention, however, it is further preferred to apply a developing bias voltage while the toner layer on the developer carrying member is caused to contact the photosensitive member in order to effectively recover and re-utilize the transfer residual toner in the developing region. The developing bias voltage may comprise a DC voltage alone or in superposition with an AC voltage.

Next, an image forming apparatus of the present invention using a two-component type developer as described also will be described.

In the image forming apparatus, a two-component type developer comprising a toner and a carrier is conveyed circulatively on a developer-carrying member and is used to develop an electrostatic latent image formed on an electrophotographic photosensitive member with the toner therein at a developing region.

The developer-carrying member comprises a rotating developer sleeve and a fixed magnet roller enclosed therein. The magnetic properties of the carrier are affected by the magnetic roller enclosed within the developing sleeve and exert a great influence on the developing performances and conveyability of the developer containing the carrier.

In order to provide excellent image uniformity and gradation reproducibility, the developing device in the image forming apparatus may preferably have such an organization that (1) the magnet roller has a multi-pole structure including a repulsion pole, (2) a magnetic flux of 500–1200 gauss is formed in the developing region, and (3) the carrier has a saturation magnetization of 20–50 $Am^2/kg$.

The developing may preferably be performed under application of a developing bias voltage by using a two-component type developer. Preferable features will be described.

Figure 5:
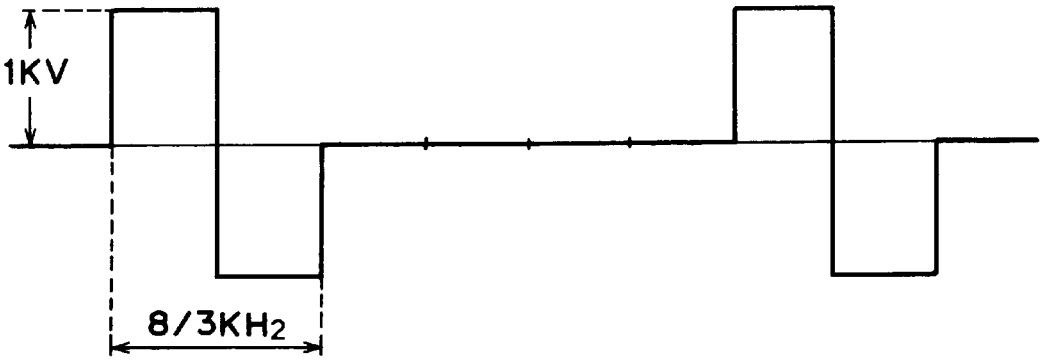
FIG. 5 is a waveform diagram showing a developing bias electric field having an intermittent AC waveform.

FIG. 5 shows an example of preferred developing bias voltage waveform used in combination with a two-component type developer, including non-successive or intermittent AC components. More specifically, the developing bias voltage includes a first voltage directing the toner from the photosensitive member to the developer-carrying member (developing sleeve), a second voltage directing the toner from the developing sleeve to the photosensitive member, respectively in the developing region, and a third voltage portion disposed between the first and second voltages.

It is further preferred to set a period ($T_2$) for applying the third voltage, i.e., a period for pause of the AC components, to be longer than the total period ($T_1$) for applying the first and second voltages, i.e., a period for applying one unit of AC component, so as to realign the toner on the photosensitive member, thereby faithfully developing the latent image.

More specifically, after providing a period ($T_1$) for forming one cycle (or one pair) of an electric field directing the toner from the photosensitive member to the developing sleeve and an electric field for directing the toner from the sleeve to the photosensitive member, a prescribed period ($T_2$) is allotted for such an electric field condition that an image portion is provided with an electric field directing the toner from the sleeve to the photosensitive member and a non-image portion is provided with an electric field directing the toner from the photosensitive member to the sleeve, on a preferred condition that $T_2$ is longer than $T_1$.

By applying a developing bias electric field comprising intermittent AC components as described above, the carrier attachment onto the photosensitive member is better suppressed. The reason therefor has not been fully clarified as yet but may be considered as follows.

In a conventionally used continual sign wave or rectangular wave electric field, if the electric field intensity is increased in order to realize high image quality and density, the toner and the carrier are altogether subjected to reciprocation between the photosensitive member and the sleeve, whereby the photosensitive member is strongly rubbed by the carrier to cause carrier attachment. This tendency is pronounced when much fine powder carrier is contained.

However, if the above-mentioned intermittent AC electric field is applied, the toner or carrier causes a reciprocal movement such that the reciprocation between the photosensitive member and the sleeve is not completed within a period of one AC unit. In the AC pause period thereafter, depending on a potential difference Vcont obtained by subtracting the DC component of the developing bias electric field from the surface potential on the photosensitive member, if Vcont<0, Vcont functions to direct the carrier from the sleeve to the photosensitive member but the actual movement thereof can be suppressed to prevent the carrier attachment by controlling the magnetic properties of the carrier and the magnetic flux caused in the developing region by the magnet roller; and if Vcont>0, the carrier is attracted to the sleeve by the magnetic field force and Vcont, thus preventing the carrier attachment.

An embodiment of the image forming apparatus using a two-component type developer according to the present invention will now be described with reference to FIG. 6.

Figure 6:
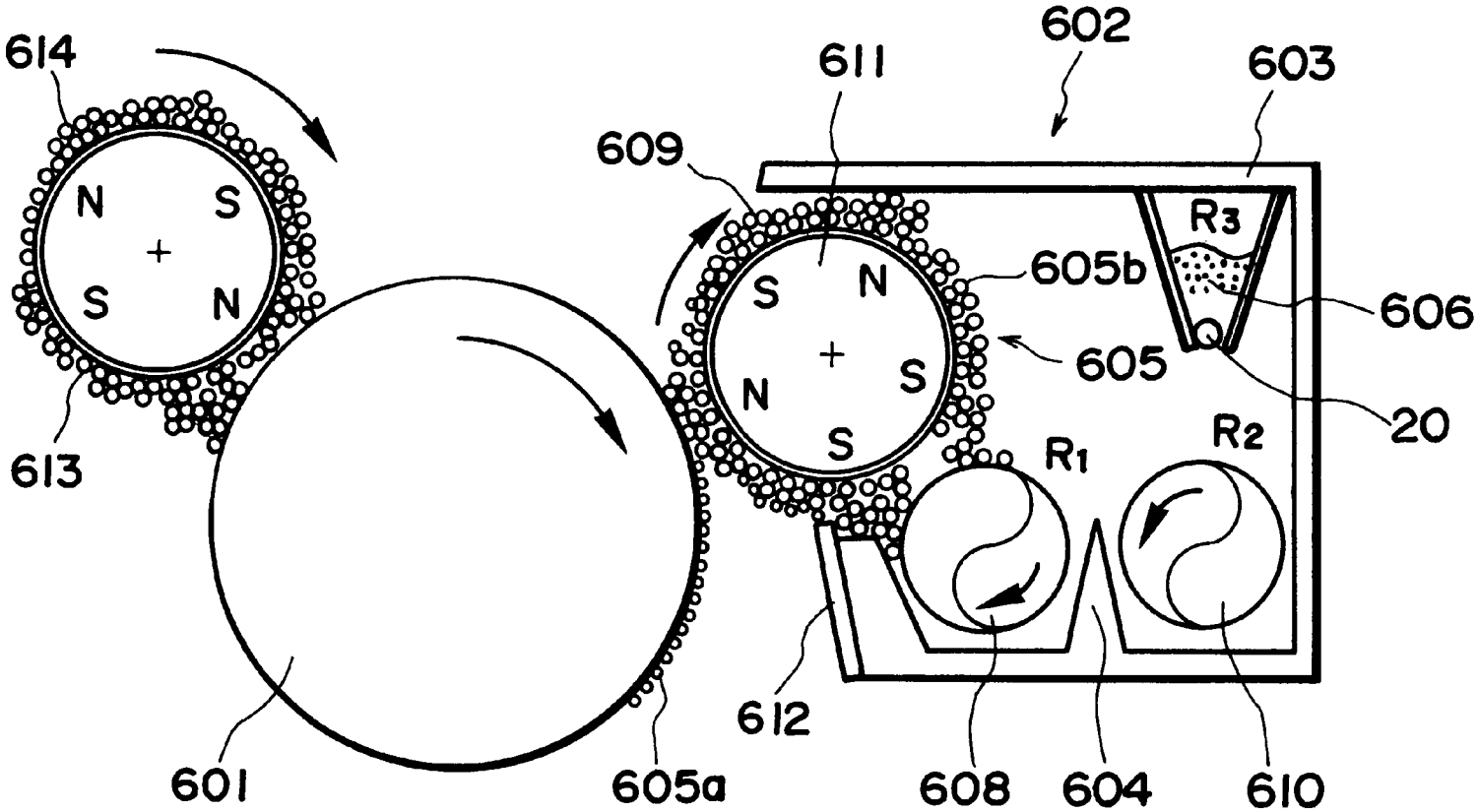
FIG. 6 is a schematic illustration of another embodiment of the electrophotographic apparatus according to the invention.

Referring to FIG. 6, the image forming apparatus includes a photosensitive drum 601 as an electrophotographic photosensitive member, and a developing device 602, which in turn includes a developer vessel 603 divided into a developing chamber (first chamber) R1 and a stirring chamber (second chamber) R2 by a partition 604. At an upper portion of the stirring chamber, a toner storage chamber R3 is provided. Within the developing chamber R1 and the stirring chamber R2, a developer 605 (comprising a toner 605*a* and a developer carrier 605*b*) is stored. On the other hand, a replenishing toner (non-magnetic toner) 606 is stored in the toner storage chamber R2 and supplied by falling through a replenishing port equipped with a supply roller or screw 20 into the stirring chamber corresponding to the amount consumed for the developing.

The developing chamber R1 is equipped with a conveyer screw 608, and the developer 605 in the developing chamber R1 is supplied in a longitudinal direction of a developing sleeve 609 by the rotation of the conveyer screw 608. Similarly, the stirring chamber R2 is equipped with a conveyer screw 610, and the toner falling into the stirring chamber R2 through the replenishing port is supplied along the longitudinal direction of the developing sleeve 609 by the rotation of the conveyer screw 610.

The developer vessel 603 is provided with an opening at a position close to the photosensitive drum 601, and the developing sleeve 609 is half projected through the opening to the outside, so as to leave a gap between the developing sleeve 609 and the photosensitive drum 601. The developing sleeve 609 is formed of a non-magnetic material, such as aluminum, and is supplied with a developing bias voltage from a bias voltage supply (not shown).

The developing sleeve 609 encloses therein a magnet roll 601, as a magnetic field generation means, including a developing pole N, a pole S downstream therefrom, and poles N, S are S for conveying the developer 605. The magnetic roll 611 is disposed so that the developing pole N thereof is opposite to the photosensitive drum 601. The developing pole N forms a magnetic field in the vicinity of a developing region at which the developing sleeve 609 and the photosensitive drum 601 face each other, and a magnetic brush of the carrier 605*b* is formed by the magnetic field.

A regulating blade 612 is disposed below the developing sleeve 609 so as to regulate the layer thickness of the developer 605 formed on the developing sleeve 609. The regulating blade 612 is formed of a non-magnetic material, such as aluminum or SUS 316 and is disposed to leave a gap of 300–1000 $\mu$m, and preferably 400–900 $\mu$m. If the gap is less than 300 $\mu$m, the magnetic carrier is liable to plug the gap, thereby resulting in irregularity in the developer layer and failing in application of the developer required for satisfactory development, whereby only developed images having a low density and much irregularity are formed. A gap of at least 400 $\mu$m is preferred in order to prevent non-uniform application (so-called blade plugging) due to unnecessary particles commingled in the developer. Above 1000 $\mu$m, the amount of developer applied onto the developing sleeve 609 is increased to fail in a required developer layer thickness regulation, whereby the magnetic carrier attached onto the photosensitive drum is increased, and the triboelectric charge of the toner is liable to become insufficient due to weakening of the developer circulation and the developer regulation by the non-magnetic blade 612, thus causing fog.

The movement of the magnetic carrier particles in the developer layer carried on the developing sleeve 609 tends to be slower as the particles leave away from the sleeve surface due to a balance between a constraint force exerted by the magnetic force, and gravity and a conveying force acting in a moving direction of the developing sleeve, even when the developing sleeve 609 is rotated in the direction of an indicated arrow. Some portion of the carrier particles can fall off from the sleeve due to gravity.

By appropriately selecting the magnetic pole N including the position thereof and the flowability and magnetic property of the magnetic carrier particles, the magnetic particles closer to the developing sleeve are preferentially moved along the developing sleeve to form a moving layer. Along with the movement of the magnetic carrier particles caused by the rotation of the developing sleeve, the developer is conveyed to the developing region to be used for developing.

On the other hand, the photosensitive drum 601 is charged by contact with charging magnetic particles 614 held on a retention member 613 and is then exposed imagewise by exposure means (not shown) to form an electrostatic latent image thereon, which is then developed by the developing device in the above described manner to form a toner image on the photosensitive drum 601.

Figure 7:
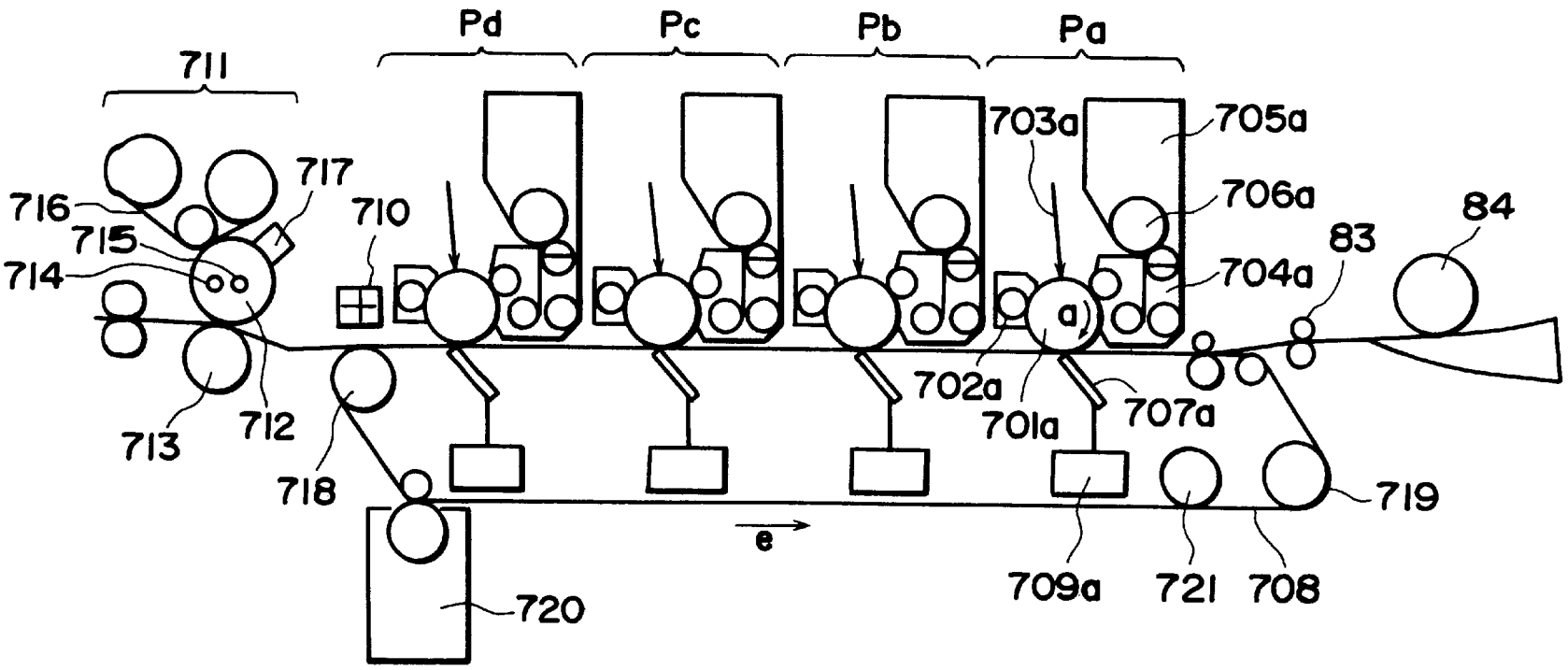
FIG. 7 is an illustration of still another embodiment of the electrophotographic apparatus according to the present invention suitable for full-color image formation.

FIG. 7 illustrates another embodiment of the image forming apparatus according to the present invention.

The image forming apparatus includes a first image forming unit Pa, a second image forming unit Pb, a third image forming unit PC and a fourth image forming unit Pd for producing respectively different colors of images on a transfer-receiving material each through a process including the steps of latent image formation, developing and transfer.

The organization of each image forming unit is described with reference to the first image forming unit Pa, for example.

The first image forming unit Pa includes a 30 mm-diameter photosensitive drum 701*a* (electrophotographic photosensitive member), which rotates in a direction of arrow a. A magnetic brush charger 702*a* comprising a 16 mm-diameter sleeve and a magnetic brush, held thereon so as to contact the photosensitive drum 701*a,* is used as a primary charger (charging means). Image light 73*a* is supplied from an exposure means (not shown) to illuminate the photosensitive drum whose surface has been uniformly charged by the primary charger 702*a,* thereby forming an electrostatic latent image on the photosensitive drum 701*a*. The image forming unit Pa further includes a developing device 704*a* (developing means) for developing the electrostatic latent image formed on the photosensitive drum 71 to form a toner image thereon. The developing device 704*a* is equipped with a toner hopper 705*a* for supplying a toner to the device through a toner supply roller 706*a*. The unit Pa further includes a transfer blade 707*a* (transfer means) for transferring the toner image formed on the photosensitive drum 701*a* to a transfer(-receiving) material conveyed by a belt-form transfer material-carrying member 708. The transfer blade 707*a* is abutted to the rear surface of the transfer material-carrying member 708 and is supplied with a transfer bias voltage from a voltage supply 709*a*.

In operation of the first image forming unit Pa, the photosensitive drum 701*a* is uniformly charged by the primary charger 702*a* and is then exposed to image light 703*a* to form an electrostatic latent image thereon, which is then developed with a toner in the developing device 704*a*. The resultant toner image on the photosensitive drum 701*a* is transferred at a first transfer position (a position at which the photosensitive drum 701*a* and a transfer material abut each other) onto the transfer material conveyed and carried by the belt-form transfer material-carrying member while applying a transfer bias voltage by the transfer blade 707*a* abutted against the lower surface of the transfer-carrying member 708.

As shown in FIG. 7, the image forming apparatus further includes the second to fourth image forming units Pb, Pc and Pd, which have identical organizations as the first image forming unit Pa except that they contain toners of respective colors (each different from the other and also from that of the color used in the first unit Pa) in their developing devices, thus including totally four image forming units Pa to Pd. For example, the first to fourth developing units Pa to Pd are designed to use a yellow toner, a magenta toner, a cyan toner, and a black toner, respectively, so that the color toner images formed in the respective units are successively transferred onto an identical transfer material at their respective transfer positions while adjusting positional alignment of the toner images. Thus, the respective color toner images are superposed onto the same transfer material through four times of transfer during a single movement of the transfer material. After the four times of transfer, the transfer material carrying the four color toner images in superposition is separated from the transfer material-carrying member 708 by the action of a separation charger 710 and is then sent to a fixing device 711 by a conveying means such as a conveyer belt, followed by a single fixing operation to form a final full color image product.

The fixing device 711 includes a 40 mm-diameter fixing roller 712 having therein heaters 714 and 715 therein, a 30 mm-diameter pressure roller 713, a cleaning web supply mechanism 716 for removing soiling on the fixing roller 712, and a temperature sensor 717 for the fixing roller 712.

Unfixed color toner images carried on a transfer material are fixed onto the transfer material under the application of heat and pressure when the transfer material is passed through a nip between the fixing roller 712 and the pressure roller 713.

The transfer material-carrying member 708 shown in FIG. 7 is an endless belt member, which is moved in the direction of arrow e around a drive roller 718 and a follower roller 719, while being subjected to charge-removal by a charge-remover 721 and registration for positional alignment by registration rollers 83 and 84.

As the transfer means, a transfer roller can also be used instead of the transfer blade.

Instead of such constant transfer means, it is also possible to use a conventionally used non-contact transfer means, such as a corona charger, disposed on a back side of the transfer material-carrying member for applying a transfer bias voltage. However, it is preferred to use a non-contact transfer means capable of suppressing the occurrence of ozone accompanying the application of a transfer bias voltage.

Hereinbelow, some methods for measurement of various physical properties or parameters will be described.

(1) Magnetic properties of a carrier

A magnetization meter ("BHU-60", available from Riken Sokutei K.K.) is used as the apparatus. Ca. 1.0 g of a sample is weighed and set in a cell having an inner diameter of 7 mm and a height of 10 mm, and the cell is set in the measurement apparatus. The magnetic field applied to the cell is gradually increased up to 3,000 Oersted at the maximum and then gradually lowered, thereby obtaining a hysteresis curve of the sample on a record paper. From the hysteresis curve, a saturation magnetization, a residual magnetization and a coercive force are obtained.

(2) Volume resistivity of a carrier

The measurement is performed in a similar manner as for the charging magnetic particles described with reference to FIG. 2 except that the sample thickness is increased to 3 mm, the load on the upper electrode 22 is increased to 15 kg, and the applied DC voltage is increased to 1000 volts.

(3) Weight-average particle size (D4) of a toner

The average particle size and particle size distribution of a toner may be measured by using Coulter Counter TA-II or Coulter Multisizer (each available from Counter Electronics, Inc.). For example, Coulter Multisizer may be used as a measurement apparatus in the following manner together with an interface for outputting a number-basis distribution and a volume-basis distribution (available from Nikkaki K.K.) and a personal computer connected thereto, and an electrolytic solution comprising ca. 1% NaCl aqueous solution which may be prepared by dissolving a reagent-grade sodium chloride or commercially available as "ISOTON-II" (from Coulter Scientific Japan). For measurement into 100 to 150 ml of the electrolytic solution, 0.1 to 5 ml of a surfactant (preferably an alkylbenzenesulfonic acid salt) is added as a dispersant, and 2–20 mg of a measurement sample is added. The resultant dispersion of the sample in the electrolytic solution is subjected to a dispersion treatment by an ultrasonic disperser for ca. 1–3 minute, and then subjected to measurement of particle size distribution by using the above-mentioned Coulter Multisizer equipped with an, e.g., 100 μm-aperture to obtain a volume-basis and a number-basis particle size distribution of particles of 2 μm or large. From the distribution, the weight-average particle size may be derived by using a central value for each channel as the representative value.

(4) Weight-average particle size (D4) of external additive

An appropriate amount of external additive sample is added to about 30–50 ml of deionized water containing a small amount of surfactant and dispersed for 2–5 μm by means of an ultrasonic disperser ("Model UD-200", available from K.K. Tomy Seiko) at an output level of 2–6. The resultant dispersion liquid is placed in a cell and, after bubbles being removed therefrom, the cell is set in Coulter counter N4 (available from Coulter Electronics). After a lapse of 10–20 minutes for placing the sample at room temperature, the particle size measurement is performed to obtain a volume-average particle size and a weight-average particle size (D4) therefrom.

(5) Hydrophobicity of external additive 0.2 g of an external additive sample is added to 50 ml of water in a 250 ml-Erlenmeyer flask. Into the liquid under stirring with a magnetic stirrer, methanol is added dropwise through a buret to suspend the additive sample in water. The ratio of the volume (V ml) of methanol required for the dispersion to the total volume of the methanol (V ml) and water (50 ml) in percentage is taken as the hydrophobicity of the sample.

(6) Volume resistivity of surface layer

For the measurement of a volume resistivity of a surface layer of a photosensitive member or a developer-carrying member, a 3 μm-thick layer of a material constituting the objective surface layer (a charge trasport layer or a charge injection layer, if present, in the case of a photosensitive member, or a surface coating layer of a developer-carrying member) is formed on an Au layer formed by vapor deposition on a polyethylene terephthalate (PET) film and subjected to measurement by using a volume resistivity measurement apparatus ("4140B pAMATER", available from Hewlett-Packard Co.) under application of a voltage of 100 volts in an environment of 23° C. and 65% RH.

Hereinbelow, the present invention will be described more specifically based on Examples and Comparative Examples. In the experimental description appearing hereinbelow, "part(s)" refers to "part(s) by weight".

First of all, some production examples for production of charging magnetic particles (Charger), photosensitive members (Drum), toners (Toner) and developer carriers (Carrier) are described.

Charger Production Example 1

The magnetic material used was copper-zinc-ferrite particles having a median particle size ($D_{V50\%}$) of 27 μm, a volume resistivity (Rp) of $5\times10^7$ ohm.cm, a magnetization ($\sigma_{1000}$) at 1000 Oe (=$8\times10^4$ A/m) of 55 $Am^2$/kg (55 emu/g), a magnetization ($\sigma_{sat}$) at 3000 Oe (=$1.2\times10^5$ A/m) of 62 $Am^2$/kg (62 emu/g) and a coercive force (Hc) of substantially 0. The coupling agent used was Compound (1) listed hereinbefore (isopropoxy-triisostearyl titanate, a coupling agent having a titanium (as a central element), an isopropoxy group (as a hydrolyzable group) and three isostearoyl groups (as a hydrophobic group)).

For production, 100 parts of the copper-zinc-ferrite particles and 0.1 part of hexane solution containing 0.1 part of Compound (1) were placed in a round-bottomed flask, and the hexane was distilled off under a reduced pressure by a rotary evaporator. Then, the resultant magnetic powder was dried for 30 min. in an oven held at 120° C. to obtain changing magnetic particles (Charger particles 1), which showed a volume resistivity (Rp) of $5\times10^7$ ohm.cm and a heating loss ($H_L$) of 0.1 wt. %, a median particle size ($D_{V50\%}$) of 27 μm.

Charger Production Example 2

Charger particles 2 ($D_{V50\%}$=27 μm, Rp=$5\times10^7$ ohm.cm, $H_L$=0.05 wt. %) were prepared in the same manner as in Charger Production Example 1 except that the amount of Compound (1) was reduced to 0.05 part.

Charger Production Example 3

Charger particles 3 ($D_{V50\%}$=27 μm, Rp=$5\times10^7$ ohm.cm, $H_L$=0.01 wt. %) were prepared in the same manner as in Charger Production Example 1 except that the amount of Compound (1) was reduced to 0.01 part.

Charger Production Example 4

Charger particles 4 ($D_{V50\%}$=27 μm, Rp=$5\times10^7$ ohm.cm, $H_L$=0.005 wt. %) were prepared in the same manner as in Charger Production Example 1 except that the amount of Compound (1) was reduced to 0.005 part.

Charger Production Example 5

Charger particles 5 ($D_{V50\%}$=27 μm, Rp=$5\times10^7$ ohm.cm, $H_L$=0.05 wt. %) were prepared in the same manner as in Charger Production Example 1 except that the coupling agent was changed to 0.05 part of Compound (5) (diisopropoxy-bis(dioctylphosphite) titanate).

Charger Production Example 6

Charger particles 6 ($D_{V50\%}$=27 μm, Rp=$5\times10^7$ ohm.cm, $H_L$=0.05 wt. %) were prepared in the same manner as in Charger Production Example 1 except that the coupling agent was changed to 0.05 part of Compound (2) (isopropoxy-tridodecylbenzenesulfonyl titanate).

Charger Production Example 7

Charger particles 7 ($D_{V50\%}$=27 μm, Rp=$5\times10^7$ ohm.cm, $H_L$=0.05 wt. %) were prepared in the same manner as in Charger Production Example 1 except that the coupling agent was changed to Compound (3) (aluminum coupling agent).

Charger Production Example 8

Charger particles 8 ($D_{V50\%}$=65 μm, Rp=$4\times10^7$ ohm.cm, $H_L$=0.05 wt. %) were prepared in the same manner as in Charger Production Example 1 except that the magnetic material was changed to 100 parts of copper-zinc-ferrite particles ($D_{V50\%}$=65 μm, Rp=$4\times10^7$ ohm.cm, $\sigma_{1000}$=53 $Am^2$/kg, σsat=61 $Am^2$/kg, Hc=ca. 0).

Charger Production Example 9

Charger particles 9 ($D_{V50\%}$=65 μm, Rp=$4\times10^7$ ohm.cm, $H_L$=0.05 wt. %) were prepared in the same manner as in Charger Production Example 8 except that the coupling agent was changed to 0.05 wt. part of Compound (5) (diisopropoxy-bis(dioctylphosphite) titanate).

Charger Production Example 10

Charger particles 10 ($D_{V50\%}$=65 μm, Rp=4×$10^7$ ohm.cm, $H_L$=0.05 wt. %) were prepared in the same manner as in Charger Production Example 8 except that the coupling agent was changed to 0.05 part of Compound (2) (isopropoxy-tridodecylbenzenesulfonyl titanate).

Charger Production Example 11

Charger particles 11 ($D_{V50\%}$=65 μm, Rp=4×$10^7$ ohm.cm, $H_L$=0.05 wt. %) were prepared in the same manner as in Charger Production Example 8 except that the coupling agent was changed to 0.05 part of Compound (3) (aluminum coupling agent).

Charger Production Example 12

Charger particles 12 ($D_{V50\%}$=27 μm, Rp=5×$10^7$ ohm.cm, $H_L$=0.05 wt. %) were prepared in the same manner as in Charger Production Example 1 except that the coupling agent was changed to 0.05 part of a titanium coupling agent of the following formula:

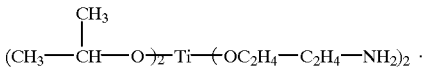

Charger Production Example 13

Charger particles 13 ($D_{V50\%}$=27 μm, Rp=5×$10^7$ ohm.cm, $H_L$=0.05 wt. %) were prepared in the same manner as in Charger Production Example 1 except that the coupling agent was changed to 0.05 part of a silane coupling agent of the following formula:

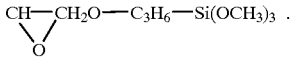

Charger Production Example 14

Charger particles 14 ($D_{V50\%}$=27 μm, Rp=5×$10^7$ ohm.cm, $H_L$=0.05 wt. %) were prepared in the same manner as in Charger Production Example 1 except that the coupling agent was changed to 0.05 part of a silane coupling agent of the following formula:

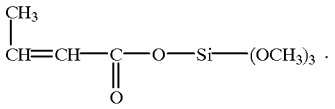

Charger Production Example 15

Charger particles 15 ($D_{V50\%}$=27 μm, Rp=5×$10^7$ ohm.cm, $H_L$=0.05 wt. %) were prepared in the same manner as in Charger Production Example 1 except that the coupling agent was changed to 0.05 part of N-β(aminoethyl-γ-aminopropyl-trimethoxysilane of the following formula:

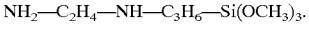

Charger Production Example 16

Charger particles 16 ($D_{V50\%}$=65 μm, Rp=4×$10^7$ ohm.cm, $H_L$=0 wt. %) were provided by using the copper-zinc-ferrite particles used in Charge Production Example 8 as it was with no coupling agent treatment.

Charger Production Example 17

Into a solution of a methylsilicone resin, copper-zinc-ferrite particles ($D_{V50\%}$=65 μm, Rp=4×$10^7$ ohm.cm, $\sigma_{1000}$=53 $Am^2$/kg, $\sigma_{sat}$=61 $Am^2$/kg, Hc=ca. 0) were dipped in a proportion of 100 parts for 1 part of the solid resin in the solution, followed by evaporation of the solvent to obtain resin-coated charging magnetic particles (Charger particles 17), which exhibited $D_{V50\%}$=66 μm, Rp=1×$10^8$ ohm.cm and $H_L$=1 wt. %.

Charger Production Example 18

Charger particles 18 ($D_{V50\%}$=66 μm, Rp=1×$10^8$ ohm.cm, $H_L$=1 wt. %) were prepared in the same manner as in Charger Production Example 17 except that the methylsilicone resin was replaced by acryl-modified silicone resin.

Charger Production Example 19

Charger particles 19 ($D_{V50\%}$=66 μm, Rp=9×$10^7$ ohm.cm, $H_L$=1 wt. %) were prepared in the same manner as in Charger Production Example 17 except that the methylsilicone resin was replaced by styrene-acrylic resin.

Charger Production Example 20

Charger particles 20 ($D_{V50\%}$=27 μm, Rp=5×$10^7$ ohm.cm, $H_L$=0.05 wt. %) were prepared in the same manner as in Charger Production Example 1 except that the coupling agent was changed to 0.05 part of Compound (10) (n-hexyltriethoxysilane).

Charger Production Example 21

Charger particles 21 ($D_{V50\%}$=65 μm, Rp=4×$10^7$ ohm.cm, $H_L$=0.05 wt. %) were prepared in the same manner as in Charger Production Example 8 except that the coupling agent was changed to 0.05 part of n-pentyltriethoxysilane.

Charge Production Example 22

8 parts of MgO, 8 parts of MnO, 4 parts of SrO and 80 parts of $Fe_2O_3$ were respectively finely pulverized, followed by mixing with added water, particle formation, calcination at 1300° C. and particle size adjustment to obtain ferrite particles, which exhibited $D_{V50\%}$=28 μm, $\sigma_{1000}$=58 $Am^2$/kg, $\sigma_{sat}$ =63 $Am^2$/kg and Hc=55 oersted.

100 parts of the ferrite particles were surface-treated with 0.1 part of isopropoxy-triisostearonyl titanate in toluene solution, to obtain changing magnetic particles (Charger particles 22), which exhibited $D_{V50\%}$=28 μm, Rp=3×$10^7$ ohm.cm, and $H_L$=0.1 wt. %.

Charger Production Example 23

Charger particles 23 ($D_{V50\%}$=28 μm, Rp=2×$10^{11}$ ohm.cm, $H_L$=0.1 wt. %, $\sigma_{1000}$=54 $Am^2$/kg, $\sigma_{sat}$=60 $Am^2$/kg, Hc=75 Oe) were prepared in the same manner as in Charger Production Example 22 except that the starting oxide mixture was changed to that of 6 parts of MgO, 5 parts of CaO and 89 parts of $Fe_2O_3$.

Charger Production Example 24

The ferrite particles prepared in Charger Production Example 23 were treated with a coating liquid prepared by dispersing or dissolving 2 parts of carbon black and 10 parts of vinylidene fluoride/methyl methacrylate copolymer in 10 parts of toluene/methyl ketone (=50/50) mixture solvent at a coating rate of 1 wt. % to obtain charging magnetic particles (Charger particles 24), which exhibited $D_{V50\%}$=29 μm, Rp=5×10$^8$ ohm.cm, $H_L$=0.05 wt. %, $\sigma_{sat}$=60 Am$^2$/kg and Hc=75 Oe.

Charger Production Example 25

Charger particles 25 ($D_{V50\%}$=29 μm, Rp=3×10$^3$ ohm.cm, $H_L$=0.05 wt. %, $\sigma_{sat}$=55 Am$^2$/kg, Hc=100 Oe) were prepared in the same manner as in Charger Production Example 22 except that the starting oxide mixture was changed to that of 8 parts of NiO, 8 parts of $Li_2O$, 4 parts of ZnO and 80 parts of $Fe_2O_3$.

Charger Production Example 26

Charger particles 26 ($D_{V50\%}$=28 μm, Rp=3×10$^7$ ohm.cm, $H_L$=0.05 wt. %, $\sigma_{sat}$=63 Am$^2$/kg, Hc=55 Oe) were prepared in the same manner as in Charger Production Example 22 except that the coupling agent was changed to isopropoxy-tridodecylbenzenesulfonyl titanate.

Charger Production Example 27

Charger particles 27 ($D_{V50\%}$=28 μm, Rp=3×10$^7$ ohm.cm, $H_L$=0.1 wt. %, $\sigma_{sat}$=63 Am$^2$/kg, Hc=55 Oe) were prepared in the same manner as in Charger Production Example 22 except that the coupling agent was changed to n-hexyltrimethoxysilane.

Drum Production Example 1

A 30 mm-dia. aluminum cylinder was coated successively with the following four layers.

First layer (electroconductive layer): Ca. 20 μm-thick electroconductive particle-dispersed resin layer for smoothing defects on the aluminum cylinder and preventing the occurrence of moire due to the reflection of laser light.

Second layer (positive charge injection-prevention layer): Ca. 1 μm-thick medium resistivity layer formed of 6-66-610-12-nylon and methoxy-methylated nylon and adjusted to have a resistivity of ca. 10$^6$ ohm.cm for preventing positive charges injected from the aluminum cylinder from diminishing negative charge provided to the photosensitive member surface.

Third layer (charge generation layer): Ca. 0.3 μm-thick oxytitanium phthalocyanine-dispersed resin layer for generating positive and negative change pairs on exposure to light.

Fourth layer (charge transport layer): Ca. 20 μm-thick hydrazone-dispersed polycarbonate resin layer (p-type semiconductor layer), not allowing the passage of negative charge provided to the photosensitive member surface but selectively transporting positive charge generated in the charge generation layer to the photosensitive member surface.

The thus-prepared photosensitive member (Photosensitive drum 1) exhibited a surface layer volume resistivity ($R_{SL}$) of 3×10$^5$ ohm.cm.

Drum Production Example 2

Photosensitive drum 2 was prepared by coating a photosensitive drum (having the same structure as Photosensitive drum 1) prepared in Drum Production Example 1 further with a 3 μm-thick fifth layer (charge injection layer) comprising 100 parts of photo-cured acrylic resin, 170 parts of about 0.03 μm-diameter $SnO_2$ particles provided with a lower resistivity by doping with antimony, 20 parts of about 0.25 μm-diameter tetrafluoroethylene particles and 1.2 parts of a dispersion aid.

Photosensitive drum 2 thus prepared exhibited $R_{SL}$=4×10$^{12}$ ohm.cm.

Drum Production Example 3

Photosensitive drum 3 was prepared by coating a 30 mm-dia. aluminum cylinder with first to fifth layers.

The first, second and fourth layers were the same as those formed in Drum Production Example 1.

The third (charge generation) layer was a about 0.3 μm-thick disazo pigment-dispersed resin layer.

The fifth (charge injection) layer was a 3 μm-thick layer comprising 100 parts of photocured acrylic resin, 160 parts of about 0.03 μm-diameter $SnO_2$ particles having a reduced oxygen content for providing a lower resistivity, 30 parts of about 0.25 μm-diameter tetrafluoroethylene resin particles, and 1.2 parts of a dispersion aid.

Photosensitive drum 3 exhibited $R_{SL}$=5×10$^{11}$ ohm.cm reduced from 5×10$^{15}$ ohm. obtained without the fifth charge injection layer.

Drum Production Example 4

Photosensitive drum 4 was prepared in the same manner as in Drum Production Example 3 except that the fifth layer was prepared by increasing the amount of the $SnO_2$ particles to 300 parts.

Photosensitive drum 4 exhibited $R_{SL}$=4×10$^7$ ohm.cm.

Drum Production Example 5

Photosensitive drum 5 was prepared in the same manner as in Drum Production Example 3 except that the fifth layer was prepared without adding the $SnO_2$ particles.

Photosensitive drum 5 exhibited $R_{SL}$=4×10$^{15}$ ohm.cm.

Toner Production Example 1

| | |
|---|---|
| Styrene-acrylic resin | 100 parts |
| Carbon black | 4 parts |
| Metal-containing azo dye | 2 parts |
| Low-molecular weight polypropylene | 3 parts |

The above ingredients were dry-blended and then kneaded through a twin-screw kneading extruder.

The kneaded product was cooled, pulverized by a pneumatic pulverizer and then pneumatically classified to provide toner particles having a prescribed particle size distribution. The toner particles were externally blended with 1.5 wt. % of hydrophobized titanium oxide particles (D4 (weight-average particle size)=0.05 μm and hydrophobicity=70%) to provide Toner 1 having a weight-average particle size (D4) of 6.5 μm.

Toner Production Example 2

88 parts of styrene, 12 parts of n-butyl acrylate, 3 parts of low-molecular weight polypropylene, 5 parts of carbon black, 1 part of metal-containing azo dye, and 3 parts of azo-type initiator were mixed to provide a polymerizable monomer composition, which was then suspended in 500 parts of de-ionized water containing 4 parts of calcium phosphate dispersed therein and subjected to 8 hours of polymerization at 70° C. The polymerizate particles were filtered out, washed, dried and classified to provide toner particles.

The toner particles were externally blended with 1.5 wt. % of hydrophobized titanium oxide particles (D4=0.05 μm, hydrophobicity=60%) to provide Toner 2 exhibiting D4=6.8 μm.

Toner 2 showed SF-1=120 and SF-2=115.

Toner Production Example 3

Into 710 parts of deionized water, 450 parts of 0.1M-$Na_3PO_4$ aqueous solution was added, and the mixture was warmed at 60° C. and stirred at 12000 rpm by a TK-type homomixer (available from Tokushu Kika Kogyo K.K.). Into the system, 68 parts of 1.0M-$CaCl_2$ aqueous solution was gradually added to form an aqueous medium containing $Ca_3(PO_4)_2$.

Separately, 150 parts of styrene and 35 parts of n-butyl acrylate (monomers), and 15 parts of C.I. Pigment Blue 15:3 (colorant) were finely dispersed in a ball mill. To the mixture were further added 3 parts of salicylic acid metal compound (charge control agent), 10 parts of saturated polyester resin (polar resin) and 50 parts of ester wax (Tmp (melting point)=70° C.) (release agent). The mixture was stirred at 12000 rpm by a TK-type homomixer (Tokushu Kika Kogyo K.K.) at 60° C. for uniform dissolution and dispersion. To the mixture, 10 parts of 2,2'-azobis(2,4-dimethylvaleronitrile) (polymerization initiator) was added to provide a polymerizable monomer composition.

The polymerizable monomer composition was charged into the above-prepared aqueous medium, and the system was stirred for 10 minutes at 10,000 rpm by a TK-type homomixer at 60° C. in an $N_2$ atmosphere to form the polymerizable monomer composition into droplets. Then, the system was heated to 80° C. under stirring by a paddle stirring blade and subjected to 10 hours of polymerization. After the polymerization, the residual monomer was distilled off under a reduced pressure. After cooling and the addition of hydrochloric acid for dissolution of the calcium phosphate, the polymerizate particles were filtered out, washed with water and dried to provide colored toner particles (D4=6.3 μm).

10 parts of the toner particles were externally blended with 1.0 part of hydrophobized anatase-form titanium oxide particles (Rp=$7\times10^9$ ohm.cm, D4=0.05 μm, $S_{BET}$ (BET specific surface are)=100 $m^2$ /g) treated with 10 wt. % of isobutyltrimethoxysilane, and 1.0 part of hydrophobized silica fine powder (D4=0.06 μm, $S_{BET}$=4 $m^2$/g) treated with 10 wt. % of hexamethyldisilazane, respectively in an aqueous medium to provide Toner 3, which exhibited D4=6.3 μm, SF-1=107 and SF-2=115.

Toner Production Example 4

| | |
|---|---|
| Polyester resin formed by polycondensation of propoxidized bisphenol with fumaric acid and trimetallic acid | 100 parts |
| Phthalocyanine pigment | 4 parts |
| Di-tert-butylsalicylic acid Al Compound | 4 parts |
| Low-molecular weight polypropylene | 4 parts |

The above-ingredients were preliminarily blended sufficiently by a Henschel mixer and melt-kneaded through a twin-screw kneading extruder. After cooling, the kneaded product was coarsely crushed by a hammer mill to about 1–2 mm and then finely pulverized by an air jet-type pulverizer, followed by classification and a mechanical sphering treatment, to provide blue toner particles (D4=5.8 μm).

100 parts of the toner particles were externally blended with 1.5 parts of hydrophobized anatase-form titanium oxide fine powder (Rp=$3\times10^{10}$ ohm.cm, D4=0.05 μm, hydrophobicity=55%) obtained by treating 100 parts of hydrophillic anatase-form titanium oxide fine powder with 10 parts of n-$C_4H_9$—Si—$(OCH_3)_3$ in aqueous medium, by a Henschel mixer to obtain Toner 4, which exhibited D4=5.8 μm, SF-1=128, SF-2=121.

Toner Production Example 5

Toner 5 (D4=6.3 μm, SF-1=107, SF-2=115) was prepared in the same manner as in Toner Production Example 3 except for replacing the hydrophobized anatase-form titanium oxide particles with hydrophobized silica fine particles (D4=0.04 μm, hydrophobicity=80%, $S_{BET}$=110 $m^2$/g, Rp=$4\times10^{14}$ ohm.cm).

Toner Production Example 6

Toner 6 (D4=6.3 μm, SF-1=108, SF-2=115) was prepared in the same manner as in Toner Production Example 3 except for replacing the hydrophobized anatase-form titanium oxide particles with hydrophobized silica fine particles (D4=0.01 μm, hydrophobicity=90%, $S_{BET}$=230 $m^2$/g, Rp=$4\times10^{13}$ ohm.cm).

Toner Production Example 7

Toner 7 (D4=6.3 μm, SF-1=108, SF-2=116) was prepared in the same manner as in Toner Production Example 3 except that 100 parts of the toner particles were externally blended with only 2 parts of rutile-form titanium oxide particles (D4=0.45 μm, hydrophobicity=50%, Rp=$8\times10^{13}$ ohm.cm).

Carrier Production Example 1

Carrier 1 (Rp=$1\times10^1$ ohm.cm, $\sigma_{sat}$=49 $Am^2$/kg, Hc=ca. 0) was prepared by coating 100 parts of nickel-zinc-ferrite particles ($D_{V50\%}$=60 μm) with 3 parts (as solid matter) of silicone varnish in a fluidized bed, and subsequent drying.

Carrier Production Example 2

Carrier 2 (Rp=$2\times10^{10}$ ohm.cm, $\sigma_{sat}$=49 $Am^2$/kg, Hc=ca. 0) was prepared in the same manner as in Carrier Production Example 1 except for using acryl-modified silicone resin as the coating resin.

Carrier Production Example 3

Into an aqueous medium containing 100 parts of phenol/formaldehyde (50/50) monomer mixture, 400 parts of 0.6 μm-diameter hematite particles surface-treated with a titanium coupling agent were uniformly dispersed, and the monomer was polymerized while adding ammonia as desired to prepare magnetic particle-containing spherical resinous carrier core particles ($D_{V50\%}$=33 μm, $\sigma_{sat}$=38 $Am^2$/kg).

Separately, 20 parts of toluene, 20 parts of butanol, 20 parts of water, and 40 parts of ice were placed in a four-necked flask. To the mixture under stirring, 40 parts of $CH_3SiCl_3/(CH_3)_2SiCl_2$ (15/10 by mol) mixture was added, followed by 30 minutes of stirring and 1 hour of condensation reaction at 60° C. Then, the resultant siloxane was sufficiently washed with water and dissolved in toluene/methyl ethyl ketone/butanol mixture solvent to obtain a silicone varnish having a solid matter content of 10%.

To the silicone varnish containing 100 parts of siloxane solid matter content, 2.0 parts of deionized water, 2.0 parts of a hardener of formula (a) below, 1.0 part of an aminosilane coupling agent of formula (b) below and 5.0 parts of a silane coupling agent of formula (c) below were simultaneously added to form a carrier coating solution:

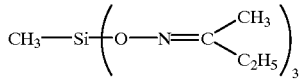

(a)

$$(CH_3)_2N—C_3H_6—Si(OCH_3)_3 \quad (b)$$

$$n.C_3H_7—Si(OCH_3)_3 \quad (c)$$

The carrier coating solution was applied onto the above-prepared carrier core particles at a coating ratio of 1 part per 100 parts of the core particles by a coating machine ("SPIRACOATER", available from Okada Seiko K.K.) to prepare Carrier 3, which exhibited $D_{V50\%}$=33 μm, Rp=4×$10^{13}$ ohm.cm, $\sigma_{sat}$=38 $Am^2$/kg, and Hc=10 oersted.

Carrier Production Example 4

Carrier 4 ($D_{V50\%}$=34 μm, Rp=9×$10^{11}$ ohm.cm, σsat=65 $Am^2$/kg, Hc=78 oersted) was prepared in the same manner as in Carrier Production Example 3 except for using only 1000 parts of the magnetite particles as the magnetic material.

Carrier Production Example 5

15 parts of NiO, 15 parts of ZnO and 70 parts of $Fe_2O_3$ were finely pulverized, and then mixed together with added water, followed by particle formation, calcination at 1200° C. and particle size adjustment to obtain ferrite carrier core particles ($D_{V50\%}$=35.8 μm).

The carrier core particles were coated with a solution of resin containing 1 wt. % of carbon black otherwise in a similar manner as in Carrier Production Example 3 to provide a developer carrier (Carrier 5), which exhibited $D_{V50\%}$=34 μm, Rp=6×$10^4$ ohm.cm, $\sigma_{sat}$=36 $Am^2$/kg and Hc=67 oersted.

Carrier Production Example 6

Carrier 6 ($D_{V50\%}$=35 μm, Rp=2×$10^{12}$ ohm.cm, $\sigma_{sat}$=55 $Am^2$/kg, Hc=7 oersted) was prepared in the same manner as in Carrier Production Example 5 except that the starting oxide mixture was changed to that of 15 parts of MgO, 10 parts of MnO and 75 parts of $Fe_2O_3$.

Carrier Production Example 7

Carrier 7 ($D_{V50\%}$=34 μm, Rp=5×$10^{14}$ ohm.cm, $\sigma_{sat}$=38 $Am^2$/kg and Hc=10 oersted) was prepared in the same manner as in Carrier Production Example 3 except for using a solution of vinylidene fluoride/methyl methacrylate copolymer instead of the silicone varnish.

EXAMPLES 1–17

Charger particles (charging magnetic particles) 1–11, 20, 22, 23 and 25–27 prepared in the corresponding Production Examples described hereinabove were used in combination with Photosensitive drum 2 (prepared in Drum Production Example 2) for measuring triboelectric chargeabilities after about 8 hours of continuous operations.

The following apparatus and method were used.

Electrophotographic apparatus

A commercially available digital copying machine using a laser beam ("GP-55", available from Canon K.K.) was remodeled to provide an electrophotographic apparatus for testing. As an outline, the digital copying machine included a corona charger as charging means for the photosensitive member, a mono-component developing device adopting a mono-component jumping developing scheme as developing means, a corona charger as transfer means, a blade cleaning means, and a pre-charging exposure means. It also included an integral unit (process cartridge) including the charger, the cleaning means and the photosensitive member, and was operated at a process speed of 150 mm/sec. The digital copying machine was remodeled in the following manner.

The developing device was remodeled from the one of the mono-component jumping development scheme to one capable of using a two-component type developer. For constituting a magnetic brush charger, a 16 mm-diameter electroconductive non-magnetic sleeve enclosing a magnet roller was disposed with a gap of 0.5 mm from the photosensitive member. A developing bias voltage was set to comprise a DC component of −500 volts superposed with a rectangular AC component of a peak-to-peak voltage of 1000 volts and a frequency of 3 kHz. The transfer means was changed from the corona charger to a roller transfer charger, and the pre-charging exposure means was removed.

Further, the cleaning blade was removed to provide a cleaner-less copying apparatus.

Figure 8:
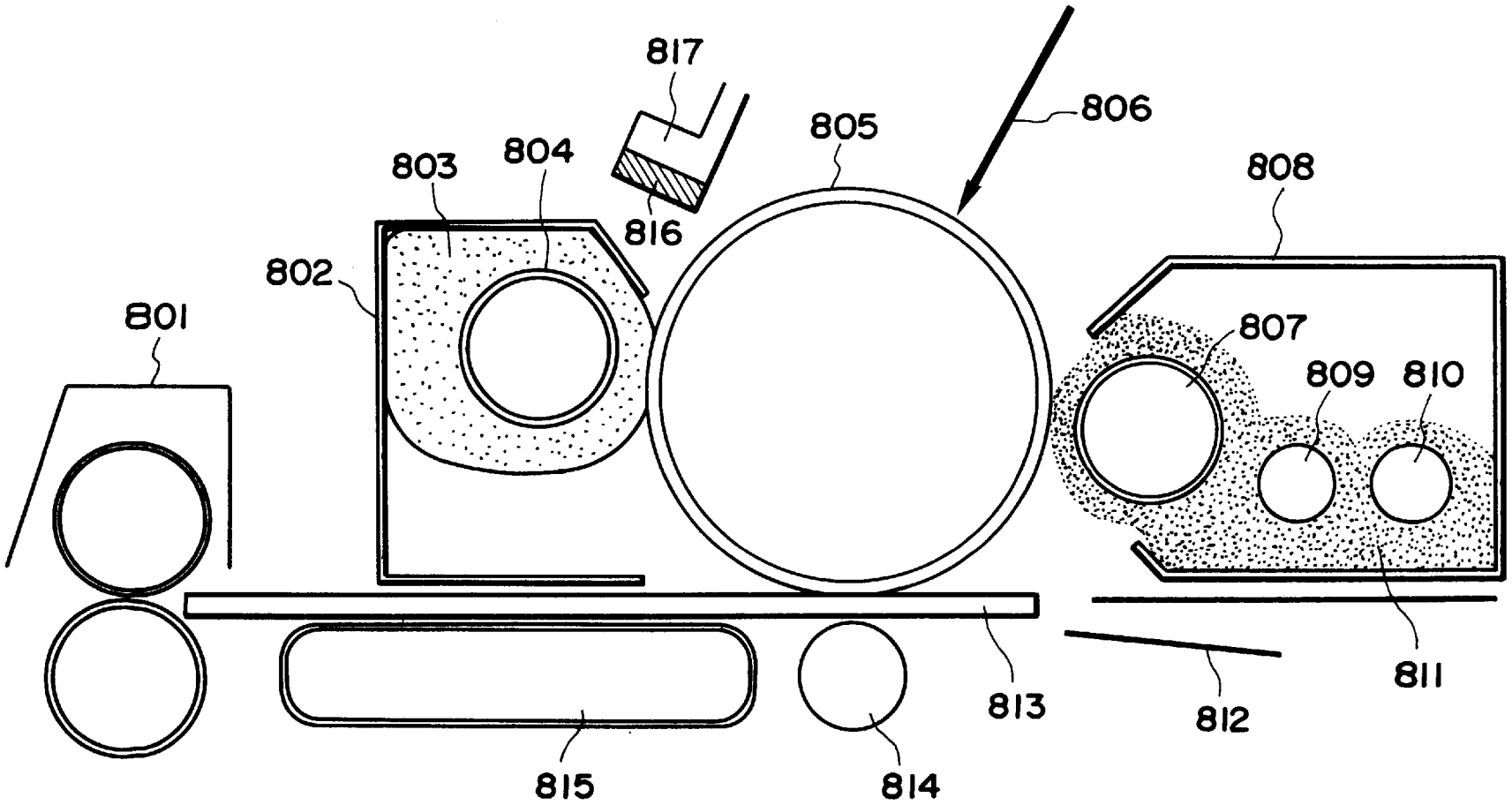
FIG. 8 is an illustration of a digital copying apparatus used in various examples.

The thus-remodeled copying apparatus had a structure as illustrated in FIG. 8 and included a charging device 801, a charger unit 802 including charging magnetic particles (Charger particles) 803 and an electroconductive sleeve 804 enclosing a magnet, a photosensitive member (Photosensitive drum) 805, a light source for supplying image light 806, a developing device 808 including a developing sleeve 807, stirring screws 809 and 810 and a developer 811, a transfer material-supply guide 812 for supplying a transfer material 813, a transfer roller 814, a transfer material-conveyer belt 815, and a holder 817 for holding an adhesive PET (polyethylene terephthalate) tape 816 for evaluating toner scattering.

Evaluation method

For evaluating the triboelectric charging ability of charging magnetic particles (Charger particles 1, etc.) and its durability, each charger particle sample was blended with Toner 1 (prepared in Toner Production Example 1) and used for measurement of the toner triboelectric charge according to the method described with reference to FIG. 3. The measured value was taken as an initial triboelectric charge. Then, each charger particle sample (803) was applied at a coating density of 180 mg/$cm^2$ on the developing sleeve 804 to provide a magnetic brush charger 802, and a photosensitive member 805 (Photosensitive drum 2) was also set in position. In this state, the sleeve 804 was rotated at a peripheral speed of 225 mm/sec in counter direction with the photosensitive member 805 rotating at a peripheral speed of 150 mm/sec. After 8 hours of continuous operation in this manner, the sample magnetic particles were recovered from the charger, and the charging ability thereof was evaluated in the same manner as a triboelectric charge provided to Toner 1.

In this manner, the triboelectric charging ability of a charger particle sample was evaluated including the degree of deterioration due to friction between the magnetic particles and friction with the photosensitive member surface.

The results of evaluation are inclusively shown in Table 1.

Comparative Examples 1–10

The triboelectric charging ability and durability of each of Charger particles 12–19, 21 and 24 were evaluated in combination with Photosensitive drum 2 otherwise in the same manner as in Example 1.

The results are also inclusively shown in Table 1.

TABLE 1

| Ex. or Comp. Ex. | Charger particles (Production Ex. No.) | Triboelectric charging ability Initial $Q_0$ | After 8 hrs. $Q_{8h}$ | Retentivity $(Q_0/Q_{8h})$x100 |
|---|---|---|---|---|
| Ex. 1 | 1 | −30 | −34 | 113 (%) |
| Ex. 2 | 2 | −28 | −30 | 107 |
| Ex. 3 | 3 | −24 | −24 | 100 |
| Ex. 4 | 4 | −19 | −18 | 95 |
| Ex. 5 | 5 | −10 | −8 | 80 |
| Ex. 6 | 6 | −28 | −24 | 86 |
| Ex. 7 | 7 | −29 | −23 | 79 |
| Ex. 8 | 8 | 28 | −24 | 86 |
| Ex. 9 | 9 | −12 | −8 | 67 |
| Ex. 10 | 10 | −26 | −22 | 85 |
| Ex. 11 | 11 | −27 | −23 | 85 |
| Ex. 12 | 20 | −20 | −12 | 60 |
| Ex. 13 | 22 | −29 | −30 | 103 |
| Ex. 14 | 23 | −30 | −31 | 103 |
| Ex. 15 | 25 | −28 | −31 | 111 |
| Ex. 16 | 26 | −34 | −32 | 94 |
| Ex. 17 | 27 | −19 | −11 | 58 |
| Comp. Ex. 1 | 12 | −40 | 0 | 0 |
| Comp. Ex. 2 | 13 | −30 | −2 | 7 |
| Comp. Ex. 3 | 14 | −26 | −4 | 15 |
| Comp. Ex. 4 | 15 | −65 | −11 | 17 |
| Comp. Ex. 5 | 16 | −14 | −1 | 7 |
| Comp. Ex. 6 | 17 | −15 | 0 | 0 |
| Comp. Ex. 7 | 18 | −37 | 0 | 0 |
| Comp. Ex. 8 | 19 | −28 | −8 | 29 |
| Comp. Ex. 9 | 21 | −18 | −6 | 33 |
| Comp. Ex. 10 | 24 | −16 | −3 | 19 |

EXAMPLE 18

Toner scattering around the charging device 802 was evaluated after a continuous image formation performed by using the electrophotographic apparatus used in Example 1 in combination with Photosensitive drum 2, a two-component type developer comprising 100 parts of Carrier 1 (developer carrier particles prepared in Carrier Production Example 1) and 6 parts of Toner 1, and Charger particles 2. Incidentally, the exhaust fan in the apparatus was stopped so as to effectively collect the scattered toner.

Figure 9:
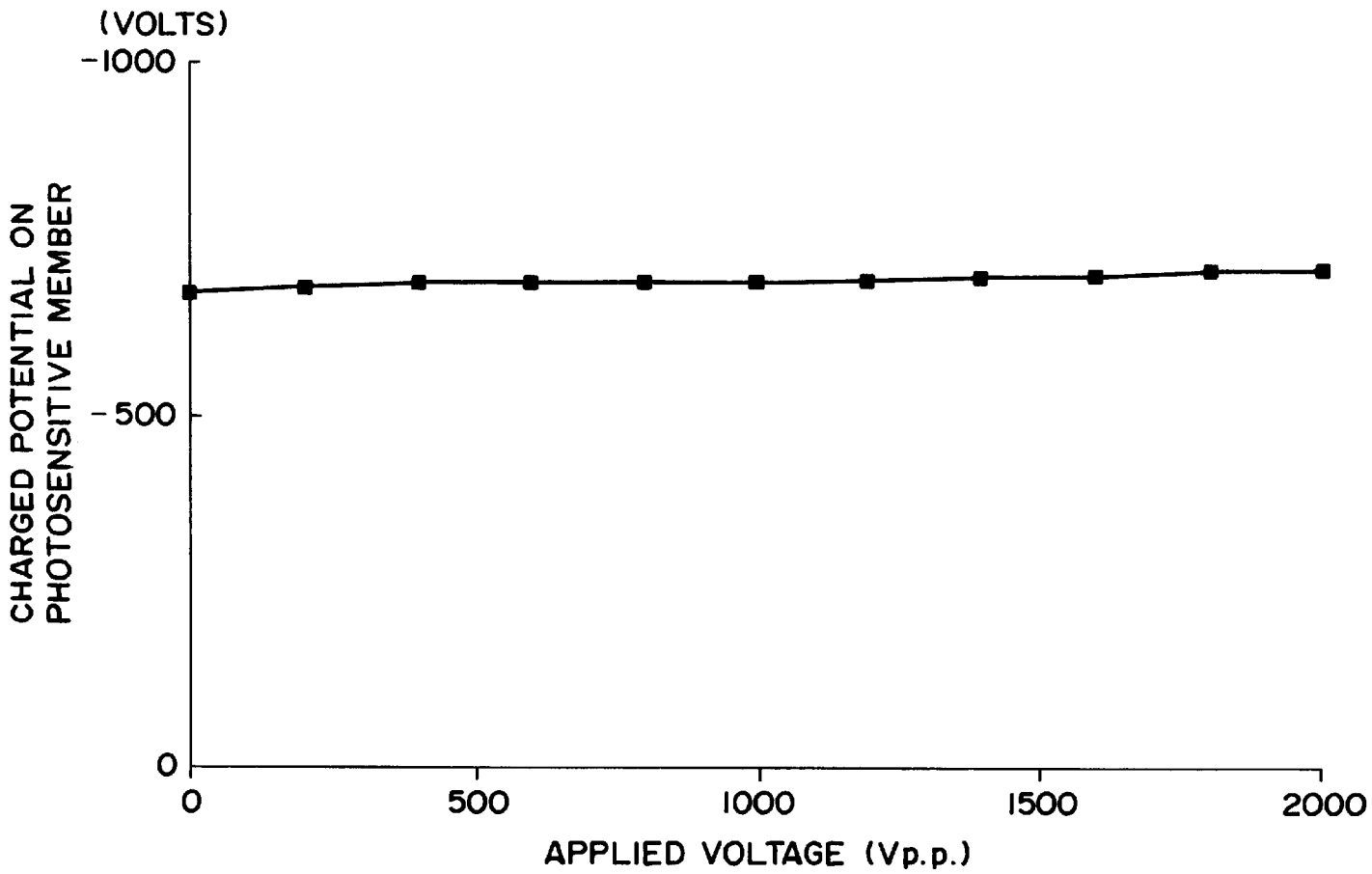
FIGS. 9 and 10 are graphs showing a peak-to-peak applied voltage dependence of charged potential on a photosensitive member in the case of the injection charging mode and the discharge-based contact charging mode, respectively.

The photosensitive member was charged according to the injection charging mode. As a result, the photosensitive member could be charged to a potential of −700 volts in response to a DC voltage component of −680 volts applied to the charger. As shown in FIG. 9, the surface potential provided to the photosensitive member was not substantially changed even when the peak-to-peak voltage level of the AC voltage component superposed with the DC voltage.

In order to evaluate the degree of toner scattering around the magnetic brush charger 802, an adhesive-coated PET tape 816 was disposed so that its adhesive-coated surface was opposite to the charging position of contact between the magnetic brush 803 and the photosensitive member 805, so as to catch scattered toner by the adhesive surface. The amount of the toner caught by the adhesive surface was evaluated by measuring the reflection density of the tape after applying the tape on white paper by a Macbeth reflection densitometer. The reflection density difference between the adhesive tape used for the scattering test and a blank adhesive tape measured in the same manner was taken as a measure for the scattered toner amount.

The image formation was performed continuously on 500 A4-size sheets fed in a lateral direction by using an original having an image ratio of 6%. The charger was supplied with a bias voltage comprising a DC component of −700 volts superposed with a rectangular AC component of 600 volts (peak-to-peak) and 1 kHz. Further, at the time of no image formation during the continuous image formation, i.e., the pre-image formation period (pre-rotation period of 2.4 sec) prior to the image formation on the first sheet, the period (of 0.6 sec) between successively fed sheets of papers (image formation period of 1.4 sec. for each sheet) and the post-image formation period (post-rotation period of 3.8 sec) after the image formation on the 500-th sheet, only the DC component of −700 volts was applied so as to send out the transfer residual toner taken in the magnetic brush 803 to the photosensitive member 805.

Such application of a charging bias voltage different from that in the image formation may be performed generally at any time during movement of the photosensitive member without image formation in addition to those specifically mentioned above in this embodiment.

During image formation, as has been described with reference to FIG. 1, the transfer residual toner is recovered with the magnetic brush, uniformly charged to a polarity identical to that of the photosensitive member 805, sent via the photosensitive member 805 and recovered or used for development by the developing device 808.

Further, as a result of a charging bias voltage application during no image formation, i.e., the period for pre-rotation, between paper supply and post-rotation, the transfer residual toner recovered within the magnetic brush 803 is sent out to the photosensitive member 805 and recovered by the developing device 808 via the photosensitive member.

For the toner scattering evaluation, the above-mentioned cycle of continuous image formation on 500 sheets was repeated 40 cycles, whereby the image formation was performed on a total of 20,000 sheets. Thereafter, the density of the toner attached on the adhesive tape was measured for the toner scattering evaluation.

The results are shown in Table 2 together with the results of the following Examples and Comparative Examples.

EXAMPLE 19

Toner scattering was evaluated in the same manner as in Example 18 except for using a developer comprising 100 parts of Carrier particles 2 (prepared in Carrier Production Example 2) and 6 parts of toner 2 (prepared in Toner Production Example 2).

EXAMPLES 20–23

Toner scattering was evaluated in the same manner as in Example 19 except that Carrier particles 2 were replaced by Carrier particles 5, 6, 7 and 20, respectively.

EXAMPLE 24

Toner scattering was evaluated in the same manner as in Example 18 except that the charging bias voltage applied during no image formation (i.e., pre-rotation, between feeds and post-rotation) was made equal to that applied during the image formation.

EXAMPLE 25

Toner scattering was evaluated in the same manner as in Example 18 except for using Photosensitive drum 1 in combination with Charger particles 8 and also a charging bias voltage comprising a DC component of −700 volts and an AC component of 1600 volts (peak-to-peak) causing discharge-based contact charging.

Figure 10:
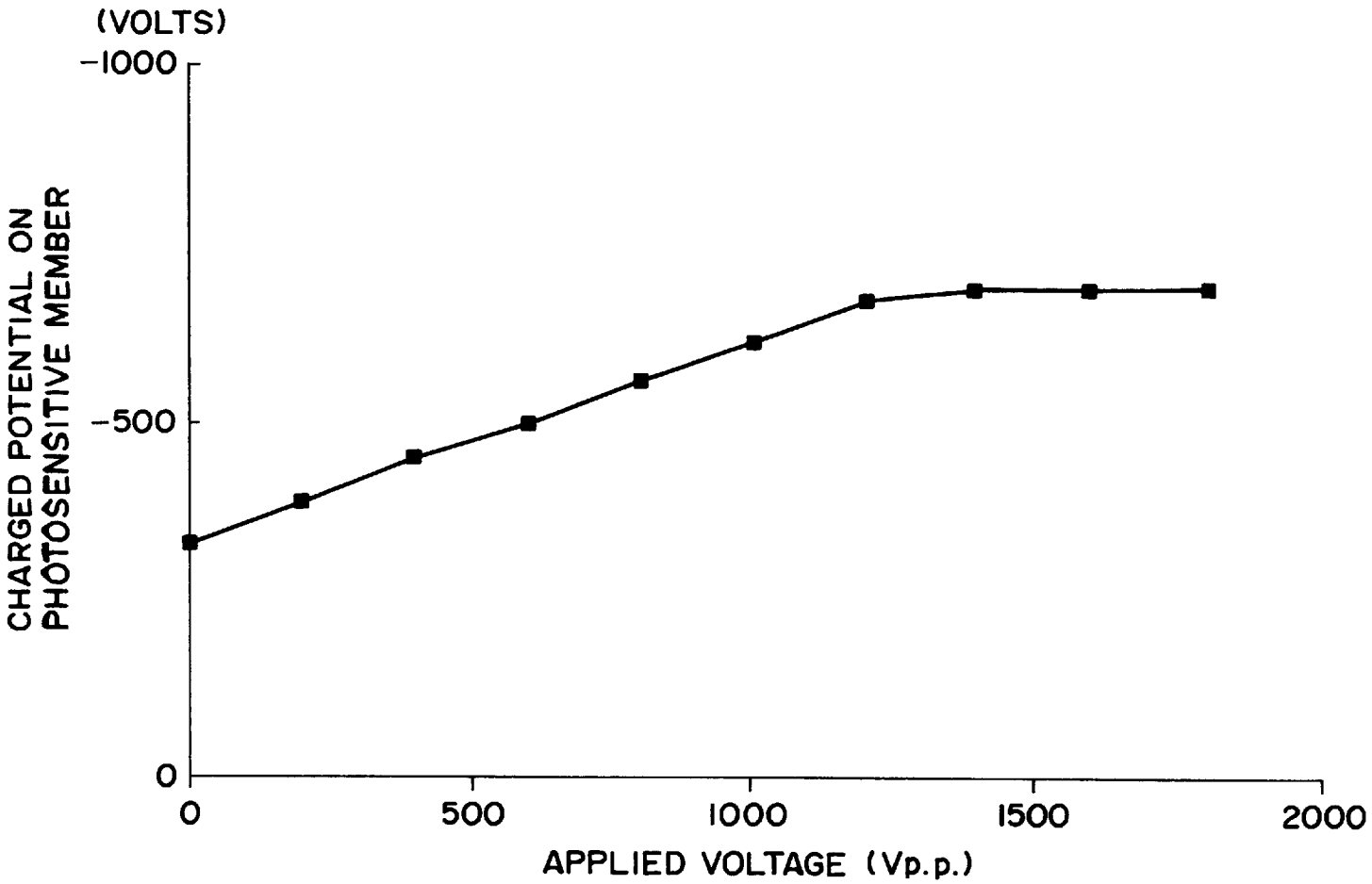

(Incidentally, FIG. 10 is a graph showing the relationship between charged potential on a photosensitive member and peak-to-peak voltages of AC component (of each 1 kHz) applied in superposition of a DC component of −700 volts in the discharge-based contact charging mode. In this case, a stable potential is attained on the photosensitive member when a half the peak-to-peak voltage exceeds the discharge initiation voltage.)

In the toner scattering evaluation, at a point after repeating a total of 30 cycles of image formation each including image formation on 500 sheets, the resultant images became accompanied by fog which was attributable to the abrasion of the photosensitive member. Accordingly, continuous image formation was stopped thereafter (i.e., after image formation on totally 15000 sheets), and the density of toner attached onto the adhesive tape was measured at this stage.

EXAMPLE 26

Toner scattering was evaluated in the same manner as in Example 25 except for using Charger particles 11 instead of Charge particles 8. Similarly as in Example 25, the resultant images were accompanied by fog attributable to the abrasion of the photosensitive member at a point after repeating totally 30 cycles of image formation. Accordingly, continuous image formation was stopped thereafter, and the density of toner attached onto the adhesive tape was measured at this stage.

COMPARATIVE EXAMPLE 11

Image formation was performed in the same manner as in Example 24 except for using Charger particles 18 instead of Charger particles 2. As a result, image deterioration became severe at a point of after image formation on 5000 sheets (10 cycles), so that image formation was stopped thereafter, and the density of toner attached onto the adhesive tape was measured at this stage.

COMPARATIVE EXAMPLE 12

Image formation was performed in the same manner as in Example 24 except for using Charger particles 19 instead of Charger particles 2. As a result, image deterioration became severe at a point of after image formation on 5000 sheets (10 cycles), so that image formation was stopped thereafter, and the density of toner attached onto the adhesive tape was measured at this stage.

COMPARATIVE EXAMPLE 13

Image formation was performed in the same manner as in Example 24 except for using Charger particles 21 instead of Charger particles 2. As a result, image deterioration became severe at a point after image formation on 10,000 sheets (20 cycles), so that image formation was stopped thereafter, and the density of toner attached onto the adhesive tape was measured at this stage.

TABLE 2

| Ex. or Comp. Ex. | Charger particles | Photo-sensitive drum | Number of sheets for image formation | Scattered toner density |
|---|---|---|---|---|
| Ex. 18 | 2 | 2 | 20000 | 0.35 |
| Ex. 19 | 2 | 2 | 20000 | 0.19 |
| Ex. 20 | 5 | 2 | 20000 | 0.34 |
| Ex. 21 | 6 | 2 | 20000 | 0.22 |
| Ex. 22 | 2 | 2 | 20000 | 0.23 |
| Ex. 23 | 20 | 2 | 20000 | 0.49 |
| Ex. 24 | 7 | 2 | 20000 | 0.43 |
| Ex. 25 | 8 | 1 | 15000 | 0.51 |
| Ex. 26 | 11 | 1 | 15000 | 0.53 |
| Comp. Ex. 11 | 18 | 2 | 5000 | 1.01 |
| Comp. Ex. 12 | 19 | 2 | 5000 | 0.82 |
| Comp. Ex. 13 | 21 | 2 | 10000 | 1.03 |

EXAMPLE 27

A cyan developer having a toner concentration of 8 wt. % was prepared by blending Toner 3 and Carrier particles 3.

The developer was subjected to continuous image formation by using an electrophotographic apparatus identical to the one used in Example 18 except that Charger particles 22 were used in combination with photosensitive drum 3. The sleeve carrying the charger particles was rotated in a counter direction with respect to the photosensitive drum at a peripheral speed of (of 180 mm/sec) that was 120% of the latter (150 mm/sec) while being supplied with a charging bias voltage comprising a DC component of −700 volts and an AC component of 1 kHz and 1200 volts (peak-to-peak). The cleaning unit was removed. Continuous copying on $3\times10^4$ sheets was performed in an environment of 23° C./65% RH by using an original having an image percentage of 10% by setting a developing contrast at 250 volts and a fog inversion contrast at −150 volts and using an intermittent electric field as shown in FIG. 5. The results are shown in Table 3 together with results of Examples and Comparative Examples described hereinafter.

Regarding the evaluation results shown in Table 3, toner scattering was evaluated with respect to the degree of soiling in the apparatus according to observation with eyes with a rough evaluation standard of A: Excellent, B: Good, and C: Poor. Image density represents values measured by a Macbeth densitometer ("RD-918"). Fog represents an average of 5 data sets of Ds−Dr, i.e., the difference between Ds (reflection density of white ground portion of sample paper after image formation) and Dr (reflection density of white ground portion of blank paper (sample paper) before image formation) measured by using a reflection densitometer ("REFLECTROMETER MODEL TC-6DS", available from Tokyo Denshoku K.K.). Solid image density is the difference between a maximum and a minimum among 5 image density values measured with respect to a solid image portion by using a Macbeth densitometer ("RD-918").

As shown in Table 3, good quality images were formed with little change during continuous image formation and without a substantial problem regarding toner scattering or due to re-utilization of the transfer residual toner.

EXAMPLE 28

Image formation was performed in the same manner as in Example 27 except for using photosensitive drum 4 instead of photosensitive drum 3. As a result, toner scattering was no problem, but the resultant images showed a lower image density and were blurred. This was presumably because the latent image charge could not be sufficiently retained due to too low a resistivity of the photosensitive member.

EXAMPLE 29

Image formation was performed in the same manner as in Example 27 except for using photosensitive drum 5 instead of photosentive drum 3. As a result, toner scattering was no problem, but the resultant images were accompanied by fog and also a periodical ghost corresponding to the photosensitive drum rotation cycle. This was presumably because the charge injection was insufficient due to high resistivity of the photosensitive member.

EXAMPLE 30

Image formation was performed in the same manner as in Example 27 except for using toner 4 instead of toner 3. Similarly good results as in Example 27 were obtained. However, when the image formation was continued up to 30,000 sheets, slight toner scattering was observed, and fog was increased to 1.2–1.5% which was however recognized to be practically no problem. This was presumably because the toner was one prepared through pulverization and sphering so that the transferability was somewhat lowered, and so that the triboelectric charging ability of the magnetic charger was somewhat lowered due to re-utilization of the transfer residual toner.

EXAMPLE 31

Image formation was performed in the same manner as in Example 27 except for using toner 5 instead of toner 3. As a result, toner scattering was no problem, but the resultant images showed a somewhat lower solid image uniformity to a level of practically no problem. This was presumably because the external additive for the toner was taken into the charging member because of a higher hydrophobicity than the anatase-form titanium oxide, thus resulting in a slight irregularity in latent image potential on the photosensitive member.

EXAMPLE 32

Image formation was performed in the same manner as in Example 27 except for using toner 6 instead of toner 3. As a result, somewhat increased toner scattering was observed, and fog became noticeable at the time of image formation on 10,000 sheets. This was presumably because the external additive was taken into the charging member because of a small particle size thus failing in providing a sufficient potential to the photosensitive member due to deterioration of the transfer residual toner.

EXAMPLE 33

Image formation was performed in the same manner as in Example 27 except for using toner 7 instead of toner 3. As a result, the resultant images showed a low image density from the initial stage, and also inferior fog and solid image uniformity. This was presumably because the toner external additive had a large particle size so that the toner charge could not be uniformized. Further, toner scattering was increased at the time of image formation on 10,000 sheets.

EXAMPLE 34

Image formation was performed in the same manner as in Example 27 except for using Charger particles 23 instead of Charger particles 22. As a result, good images were formed at the initial stage, but at the time of 10,000 sheets, image irregularity occurred while toner scattering was no problem. This was presumably because the photosensitive gradually failed to be charged uniformly in continuous copying due to high resistivity of the charging photosensitive member.

COMPARATIVE EXAMPLE 14

Image formation was performed in the same manner as in Example 30 except for using Charger particles 24 instead of Charger particles 22. As a result, noticeable toner scattering occurred, whereby the optical system in the apparatus had to be frequently cleaned. The resultant image were good up to 10,000 sheets but were accompanied by fog at the time of 30,000 sheets. The inferior results were presumably because the charger particles were coated with a resin containing carbon black, and the coating was deteriorated during the continuous image formation, thus resulting in non-uniform resistivity and a lowering in the ability of triboelectrically charging the toner.

EXAMPLE 35

Image formation was performed in the same manner as in Example 27 except for using Charger particles 25 instead of Charger particles 22. As a result, the resultant images were abnormal from the initial stage. This was presumably because the current leakage occurred due to the low resistivity of the charger particles. Accordingly, a resistance of 0.1 M.ohm was inserted in series between the charging member and the voltage source, whereby toner scattering was suppressed to a level of no problem up to 10,000 sheets.

EXAMPLE 36

Image formation was performed in the same manner as in Example 27 except for using Charger particles 26 instead of Charger particles 22, whereby good results were obtained.

EXAMPLE 37

Image formation was performed in the same manner as in Example 27 except for using Charger particles 27 instead of Charger particles 22. As a result, some toner scattering was observed and fog became noticeable at the time of 30,000 sheets, but they were at levels of practically no problem. The slight inferior results might be attributable to somewhat lower durability of the coupling agent having 6 carbon atoms.

EXAMPLE 38

Image formation was performed in the same manner as in Example 27 except for using Carrier particles 4 instead of Carrier particles 3. As a result, some toner scattering was observed, and the solid image uniformity was somewhat lowered, but they were at levels of practically no problem at all. Because of high magnetic properties of the carrier, the toner might have been slightly damaged in the developing region, to have somewhat inferior developing performance.

EXAMPLE 40

Image formation was performed in the same manner as in Example 27 except for using Carrier particles 6 instead of Carrier particles 3, whereby good results were obtained.

EXAMPLE 41

Image formation was performed in the same manner as in Example 27 except for using Carrier particles 7 instead of Carrier particles 3. As a result, toner scattering was of no problem. The solid image uniformity was somewhat lowered at the time of 30,000 sheets but it was at a level of practically no problem at all. The difference in coating material might have caused somewhat increased spent toner accumulation.

EXAMPLE 42

Toner 3 (cyan toner) was provided. Further, a yellow toner, a magenta toner and a black toner were prepared in the same manner as in Toner Production Example 3 except for replacing C.I. Pigment Blue 15:3 with C.I. Pigment Yellow 17, a quinacridone pigment, and carbon black, respectively.

The respective color toners were blended with Carrier particles 3 to provide a toner concentration of 8wt. % similarly as in Example 27.

These color toners were respectively incorporated in the developing units Pa, Pb, Pc and Pd of a full-color image forming apparatus as shown in FIG. 7 without using the cleaning units. Full-color image formation was performed successively on 30,000 sheets in the color order of yellow, magenta, cyan and black under charging conditions and developing conditions similar to those adopted in Example 27, whereby good images free from fog were obtained with little image density change.

EXAMPLE 43

Image formation was performed in a similar manner as in Example 27 except for replacing the developing unit with one of non-magnetic mono-component-type developing scheme as shown in FIG. 4, wherein a developer-carrying member 142 comprised an elastic urethane rubber sleeve provided with a surface layer of polyamide containing methacrylate resin particles dispersed therein so as to provide a volume resistivity of $2\times10^{13}$ ohm.cm, and a silicone rubber blade 145 was abutted thereto. As a result of continuous image formation on 30,000 sheets, good results were obtained.

What is claimed is:

1. An electrophotographic apparatus, comprising:

an electrophotographic photosensitive member; and (i) charging means for charging said electrophotographic photosensitive member, (ii) imagewise exposure means for exposing said electrophotographic photosensitive member to light, (iii) developing means for developing an image formed on the electrophotographic photosensitive member and (iv) transfer means for transferring the developed image onto a transfer medium, disposed in this order opposite to the electrophotographic photosensitive member, wherein said charging means includes a charging member comprising magnetic particles disposed in contact with the electrophotographic photosensitive member so as to charge the electrophotographic photosensitive member based on a voltage received thereby, said magnetic particles are surface-coated with a coupling agent having a linear alkyl group having at least 6 carbon atoms, and said developing means also functions to recover residual toner remaining on the electrophotographic photosensitive member after processing by the transfer means and the charging means, wherein the developing means supplies a toner containing an external additive, the toner has a weight-average particle size of 1–9 $\mu$m, and the external additive has a weight-average particle size of 0.012–0.4 $\mu$m.

2. An electrophotographic apparatus according to claim 1, wherein said developing means is the only element in said apparatus for recovering residual toner remaining on the electrophotographic photosensitive member after processing by the transfer means between the transfer means and the charging means or between the charging means and the developing means.

3. An electrophotographic apparatus according to claim 1 or 2, wherein the linear alkyl group of the coupling agent has at least 8 carbon atoms.

TABLE 3

| | | | | | | Continuous image forming performance* | | |
|---|---|---|---|---|---|---|---|---|
| Ex. or Comp. Ex. | Photo-sensitive drum | Charger | Carrier | Toner | Toner scattering | Image density init/$10^4$/3 × $10^4$ | Fog (%) init/$10^4$/3 × $10^4$ | Solid image density change init/$10^4$/3 × $10^4$ |
| Ex. | | | | | | | | |
| 27 | 3 | 22 | 3 | 3 | A | 1.5/1.4/1.5 | 0.2/0.5/0.7 | 0.02/0.03/0.03 |
| 28 | 4 | 22 | 3 | 3 | A | 0.8/1.1/— | 1.4/1.9/— | 0.13/0.21/— |
| 29 | 5 | 22 | 3 | 3 | A | 1.4/1.5/— | 1.8/2.5/— | 0.15/0.18/— |
| 30 | 3 | 22 | 3 | 4 | A⁻ | 1.6/1.7/1.6 | 0.4/0.7/1.4 | 0.03/0.05/0.05 |
| 31 | 3 | 22 | 3 | 5 | A | 1.5/1.5/1.4 | 0.3/0.5/1.0 | 0.01/0.04/0.07 |
| 32 | 3 | 22 | 3 | 6 | B | 1.6/1.3/— | 0.2/1.7/— | 0.01/0.12/— |
| 33 | 3 | 22 | 3 | 7 | B | 0.8/1.0/— | 1.5/2.3/— | 0.2/0.22/— |
| 34 | 3 | 23 | 3 | 3 | A | 1.5/1.4/— | 0.5/1.2/— | 0.05/0.15/— |
| Comp. Ex. | | | | | | | | |
| 14 | 3 | 24 | 3 | 4 | C | 1.7/1.6/1.3 | 0.3/0.7/1.5 | 0.04/0.07/— |
| Ex. | | | | | | | | |
| 35 | 3 | 25 | 3 | 3 | A | 1.6/1.7/— | 0.9/1.0/— | 0.05/0.09/— |
| 36 | 3 | 26 | 3 | 3 | A | 1.5/1.5/1.5 | 0.3/0.6/1.0 | 0.02/0.03/0.05 |
| 37 | 3 | 27 | 3 | 3 | A⁻ | 1.5/1.5/1.4 | 0.2/0.9/1.1 | 0.02/0.02/0.04 |
| 38 | 3 | 22 | 4 | 3 | A⁻ | 1.5/1.5/1.5 | 0.3/0.4/0.9 | 0.02/0.04/0.06 |
| 39 | 3 | 22 | 5 | 3 | A | 1.3/1.3/— | 1.2/1.5/— | 0.07/1.17/— |
| 40 | 3 | 22 | 6 | 3 | A | 1.5/1.5/1.5 | 0.3/0.6/0.9 | 0.03/0.04/0.06 |
| 41 | 3 | 22 | 7 | 3 | A | 1.5/1.6/1.4 | 0.3/0.7/0.9 | 0.04/0.06/0.09 |

*"—" in the table represents that the image forming operation was interrupted before 3 × $10^4$ sheets.

4. An electrophotographic apparatus according to claim 1 or 2, wherein the linear alkyl group of the coupling agent has at least 12 carbon atoms.

5. An electrophotographic apparatus according to claim 1 or 2, wherein the linear alkyl group of the coupling agent has at most 30 carbon atoms.

6. An electrophotographic apparatus according to claim 1 or 2, wherein the coupling agent is contained in a proportion of 0.0001–0.5 wt. % of the magnetic particles.

7. An electrophotographic apparatus according to claim 1 or 2, wherein the coupling agent is contained in a proportion of 0.001–0.2 wt. % of the magnetic particles.

8. An electrophotographic apparatus according to claim 1 or 2, wherein the magnetic particles have a heating loss of at most 0.5 wt. %.

9. An electrophotographic apparatus according to claim 1 or 2, wherein the magnetic particles have a heating loss of at most 0.2 wt. %.

10. An electrophotographic apparatus according to claim 1 or 2, wherein the coupling agent has titanium, aluminum or silicon as its central atom.

11. An electrophotographic apparatus according to claim 1 or 2, wherein the magnetic particles have a volume resistivity of $1\times10^4$–$1\times10^9$ ohm.cm.

12. An electrophotographic apparatus according to claim 1 or 2, wherein the magnetic particles have an average particle size of 5–100 $\mu$m.

13. An electrophotographic apparatus according to claim 12, wherein the average particle size of the magnetic particles is at most 50 $\mu$m.

14. An electrophotographic apparatus according to claim 12, wherein the average particle size of the magnetic particles is at most 35 $\mu$m.

15. An electrophotographic apparatus according to claim 1 or 2, wherein the electrophotographic photosensitive member has a charge injection layer as its surfacemost layer.

16. An electrophotographic apparatus according to claim 15, wherein the charge injection layer has a volume resistivity of $1\times10^8$–$1\times10^{15}$ ohm.cm.

17. An electrophotographic apparatus according to claim 1 or 2, wherein the developing means supplies a toner having a shape factor SF-1 of 100–160, and a shape factor SF-2 of 100–140.

18. An electrophotographic apparatus according to claim 1 or 2, wherein the developing means supplies a toner having a shape factor SF-1 of 100–140, and a shape factor SF-2 of 100–140.

19. An electrophotographic apparatus according to claim 1, wherein the external additive has a hydrophobicity of 20–80%.

20. An electrophotographic apparatus according to claim 1 or 2, wherein the developing means is a reversal development means.

21. An electrophotographic apparatus according to claim 1 or 2, wherein the developing means is a two-component type developing means.

22. An image forming method, comprising a cycle of:

a charging step of charging an electrophotographic photosensitive member by a charging means disposed in contact with the electrophotographic photosensitive member, an exposure step of exposing the charged electrophotographic photosensitive member to image light to form an electrostatic image on the electrophotographic photosensitive member, a developing step of developing the electrostatic image with a toner supplied from a developing means to form a toner image on the electrophotographic photosensitive member, and a transfer step of transferring the toner image on the electrophotographic photosensitive member onto a transfer-receiving material; wherein said charging means includes a charging member comprising magnetic particles disposed in contact with the electrophotographic photosensitive member so as to charge the electrophotographic photosensitive member based on a voltage received thereby, said magnetic particles are surface-coated with a coupling agent having a linear alkyl group having at least 6 carbon atoms, and residual toner remaining on the electrophotographic photosensitive member after the transfer step is processed by the charging member and recovered by the developing means in the charging step after the developing step, respectively, in a subsequent cycle, wherein in the developing step a toner containing an external additive is used, the toner has a weight-average particle size of 1–9 $\mu$m, and the external additive has a weight-average particle size of 0.012–0.4 $\mu$m.

23. An image forming method according to claim 22, wherein said developing means is the only element in said apparatus for recovering residual toner remaining on the electrophotographic photosensitive member after the transfer step between the transfer step and the charging step or between the charging step and the developing step.

24. An image forming method according to claim 22 or 23, wherein the linear alkyl group of the coupling agent has at least 8 carbon atoms.

25. An image forming method according to claim 22 or 23, wherein the linear alkyl group of the coupling agent has at least 12 carbon atoms.

26. An image forming method according to claim 22 or 23, wherein the linear alkyl group of the coupling agent has at most 30 carbon atoms.

27. An image forming method according to claim 22 or 23, wherein the coupling agent is contained in a proportion of 0.0001–0.5 wt. % of the magnetic particles.

28. An image forming method according to claim 22 or 23, wherein the coupling agent is contained in a proportion of 0.001–0.2 wt. % of the magnetic particles.

29. An image forming method according to claim 22 or 23, wherein the magnetic particles have a heating loss of at most 0.5 wt. %.

30. An image forming method according to claim 22 or 23, wherein the magnetic particles have a heating loss of at most 0.2 wt. %.

31. An image forming method according to claim 22 or 23, wherein the coupling agent has titanium, aluminum or silicon as its central atom.

32. An image forming method according to claim 22 or 23, wherein the magnetic particles have a volume resistivity of $1\times10^4$–$1\times10^9$ ohm.cm.

33. An image forming method according to claim 22 or 23, wherein the magnetic particles have an average particle size of 5–100 $\mu$m.

34. An image forming method according to claim 33, wherein the average particle size of the magnetic particles is at most 50 $\mu$m.

35. An image forming method according to claim 33, wherein the average particle size of the magnetic particles is at most 35 $\mu$m.

36. An image forming method according to claim 22 or 23, wherein the electrophotographic photosensitive member has a charge injection layer as its surfacemost layer.

37. An image forming method according to claim 36, wherein the charge injection layer has a volume resistivity of $1\times10^{8}$–$1\times10^{15}$ ohm.cm.

38. An image forming method according to claim 22 or 23, wherein the developing means supplies a toner having a shape factor SF-1 of 100–160, and a shape factor SF-2 of 100–140.

39. An image forming method according to claim 22 or 23, wherein a toner used in the developing step has a shape factor SF-1 of 100–140, and a shape factor SF-2 of 100–140.

40. An image forming method according to claim 21 wherein the external additive has a hydrophobicity of 20–80 %.

41. An image forming method according to claim 22 or 23, wherein the developing step is a reversal development step.

42. An image forming method according to claim 22 or 23, wherein the developing step is a two-component type developing step.

43. A process cartridge, comprising:

an electrophotographic photosensitive member; and charging means forming an integral unit with said electrophotographic photosensitive member, which is detachably mountable to a main assembly to form an electrophotographic photosensitive apparatus; said electrophotographic apparatus including the electrophotographic photosensitive member, and (i) said charging means for charging said electrophotographic photosensitive member, (ii) imagewise exposure means for exposing said electrophotographic photosensitive member to light, (iii) developing means for developing an image formed on said electrophotographic photosensitive member, and (iv) transfer means for transferring the developed image onto a transfer material, disposed in this order opposite to the photosensitive member, wherein said charging means includes a charging member comprising magnetic particles disposed in contact with the electrophotographic photosensitive member so as to charge the electrophotographic photosensitive member based on a voltage received thereby, said magnetic particles are surface-coated with a coupling agent having a linear alkyl group having at least 6 carbon atoms, and said developing means also functions to recover residual toner remaining on the electrophotographic photosensitive member after processing by the transfer means and the charging means, wherein the developing means supplies a toner containing an external additive, the toner has a weight-average particle size of 1–9 $\mu$m, and the external additive has a weight-average particle size of 0.012–0.4 $\mu$m.

44. An process cartridge according to claim 43, wherein said developing means is the only element in said apparatus for recovering residual toner remaining on the electrophotographic photosensitive member after processing by the transfer means between the transfer means and the charging means or between the charging means and the developing means.

45. An process cartridge according to claim 43 or 44, wherein the linear alkyl group of the coupling agent has at least 8 carbon atoms.

46. An process cartridge according to claim 43 or 44, wherein the linear alkyl group of the coupling agent has at least 12 carbon atoms.

47. An process cartridge according to claim 43 or 44, wherein the linear alkyl group of the coupling agent has at most 30 carbon atoms.

48. An process cartridge according to claim 43 or 44, wherein the coupling agent is contained in a proportion of 0.0001–0.5 wt. % of the magnetic particles.

49. An process cartridge according to claim 43 or 44, wherein the coupling agent is contained in a proportion of 0.001–0.2 wt. % of the magnetic particles.

50. An process cartridge according to claim 43 or 44, wherein the magnetic particles have a heating loss of at most 0.5 wt. %.

51. An process cartridge according to claim 43 or 44, wherein the magnetic particles have a heating loss of at most 0.2 wt. %.

52. An process cartridge according to claim 43 or 44, wherein the coupling agent has titanium, aluminum or silicon as its central atom.

53. An process cartridge according to claim 43 or 44, wherein the magnetic particles have a volume resistivity of $1\times10^{4}$–$1\times10^{9}$ ohm.cm.

54. An process cartridge according to claim 43 or 44, wherein the magnetic particles have an average particle size of 5–100 $\mu$m.

55. An process cartridge according to claim 54, wherein the average particle size of the magnetic particles is at most 50 $\mu$m.

56. An process cartridge according to claim 54, wherein the average particle size of the magnetic particles is at most 35 $\mu$m.

57. An process cartridge according to claim 43 or 44, wherein the electrophotographic photosensitive member has a charge injection layer as its surfacemost layer.

58. An process cartridge according to claim 57, wherein the charge injection layer has a volume resistivity of $1\times10^{8}$–$1\times10^{15}$ ohm.cm.

59. An process cartridge according to claim 43 or 44, wherein the developing means supplies a toner having a shape factor SF-1 of 100–160, and a shape factor SF-2 of 100–140.

60. An process cartridge according to claim 43 or 44 wherein the developing means supplies a toner having a shape factor SF-1 of 100–140, and a shape factor SF-2 of 106–140.

61. An process cartridge according to claim 43, wherein the external additive has a hydrophobicity of 20–80%.

62. An process cartridge according to claim 43 or 44, wherein the developing means is a reversal development means.

63. An process cartridge according to claim 43 or 44, wherein the developing means is a two-component type developing means.

* * * * *

UNITED STATES PATENT AND TRADEMARK OFFICE

CERTIFICATE OF CORRECTION

PATENT NO. : 6,285,848 B1
APPLICATION NO. : 09/092935
DATED : September 4, 2001
INVENTOR(S) : Shuichi Aita et al.

It is certified that error appears in the above-identified patent and that said Letters Patent is hereby corrected as shown below:

COVER PAGE AT ITEM [56] RC:
Foreign Patent Documents: "58-139156 8/1993 (JP)." should read --58-139156 8/1983 (JP).--.

COVER PAGE AT ITEM [57] ABSTRACT:
Line 15, "changeabil-" should read --chargeabil---.

COLUMN 2:
Line 53, "form" (second occurrence) should be deleted.

COLUMN 3:
Line 53, "the" should be deleted.

COLUMN 4:
Line 17, "a" should read --of a--.

COLUMN 5:
Line 5, "effects to" should read --affect--;
Line 31, "including" should read --including,--;
Line 44, "photo-" should be deleted;
Line 45, "sensitive members 15," should read --magnetic particles 15,--.

COLUMN 7:
Line 67, "following" should read --following:--.

COLUMN 8:
Line 5, Compound 1: "s" should read --3--;
Line 50, Compound 9: "s" should read --3--.

COLUMN 9:
Line 17, "meter 23" should read --meter 25--;
Line 52, "in.a" should read --in a--;
Line 58, "$D_{v50}$%)." should read --$D_{v50\%}$).--.

COLUMN 10:
Line 41, "with" should read --by--;

COLUMN 12:
Line 33, "chain" (second occurrence) should read --chain;--.

UNITED STATES PATENT AND TRADEMARK OFFICE

CERTIFICATE OF CORRECTION

PATENT NO. : 6,285,848 B1
APPLICATION NO. : 09/092935
DATED : September 4, 2001
INVENTOR(S) : Shuichi Aita et al.

It is certified that error appears in the above-identified patent and that said Letters Patent is hereby corrected as shown below:

COLUMN 13:
Line 8, “condition” should read --conditions--;
Line 39, “include;” should read --include:--.

COLUMN 14:
Line 59, “(e.g.” should read --(e.g.,--;

COLUMN 15:
Line 66, “are” should read --is--.

COLUMN 16:
Line 7, “become” should read --becomes--;
Line 59, “if the particle” should be deleted;
Line 60, “size is fog, and” should read --fog, and if the particle size is--.

COLUMN 17:
Line 4, “2 10 wt. parts,” should read --2-10 wt. parts,--;
Line 44, “particular” should read --particularly--.

COLUMN 20:
Line 53, “($D_{v50}$%)” should read --($D_{v50\%}$)--.

COLUMN 21:
Line 27, “developer-or” should read --developer- or--.

COLUMN 23:
Line 60, “chamber R2” should read --chamber R3--.

COLUMN 24:
Line 15, “601,” should read --611,--.
Line 17, “are S” should read --are--.

COLUMN 25:
Line 8, “unit PC” should read --unit Pc--;
Line 23, “73a” should read --703a--;
Line 29, “drum 71” should read --drum 701a--;

COLUMN 26:
Line 39, “Ca.” should read --About--;
Line 63, “ca.” should read --about--.

UNITED STATES PATENT AND TRADEMARK OFFICE

CERTIFICATE OF CORRECTION

PATENT NO. : 6,285,848 B1
APPLICATION NO. : 09/092935
DATED : September 4, 2001
INVENTOR(S) : Shuichi Aita et al.

It is certified that error appears in the above-identified patent and that said Letters Patent is hereby corrected as shown below:

COLUMN 27:
Line 5, "ca. 1-3 minute," should read --about 1-3 minutes,--;
Line 44, "pAMATER"," should read --PAMATER,"--.

COLUMN 28:
Line 59, "Hc=ca. 0)." should read --Hc=about 0).--.

COLUMN 29:
Line 60, "aminopropyl-trimethoxysilane" should read --aminopropyl-trimethoxysilane)--.

COLUMN 30:
Line 7, "Hc=ca. 0)." should read --Hc=about 0).--.

COLUMN 31:
Line 33, "30mm-dia." should read --30mm-diameter--;
Line 35, "Ca." should read --About--;
Line 40, "Ca." should read --About--;
Line 42, "ca." should read --about--;
Line 46, "Ca." should read --About--;
Line 50, "Ca." should read --About--.

COLUMN 32:
Line 23, "$5x10^{15}$ ohm." should read --$5x10^{15}$ ohm.cm--.

COLUMN 33:
Line 48, "are)" should read --area--.

COLUMN 34:
Line 42, "(Rp=$1x10^{1}$ ohm.cm," should read --(Rp=$1x10^{10}$ ohm.cm,--; and "Hc=ca.0)" should read --Hc=about 0)--;
Line 48, "Hc=ca." should read --Hc=about--.

COLUMN 36:
Line 57, delete "developing";

COLUMN 37:
Line 28, in Table 1, in Example 8, "28" should read ---28--.

UNITED STATES PATENT AND TRADEMARK OFFICE

CERTIFICATE OF CORRECTION

PATENT NO. : 6,285,848 B1
APPLICATION NO. : 09/092935
DATED : September 4, 2001
INVENTOR(S) : Shuichi Aita et al.

It is certified that error appears in the above-identified patent and that said Letters Patent is hereby corrected as shown below:

COLUMN 42:
Line 3, “photosensitive” should read --photosensitive drum--;

COLUMN 46:
Line 5, “material;” should read --material,--;

COLUMN 47:
Line 27, “said” should be deleted;
Line 54, “An” should read --A--.

COLUMN 48:
Line 1, “An” should read --A--;
Line 4, “An” should read --A--;
Line 7, “An” should read --A--;
Line 10, “An” should read --A--;
Line 13, “An” should read --A--;
Line 16, “An” should read --A--;
Line 19, “An” should read --A--;
Line 22, “An” should read --A--;
Line 25, “An” should read --A--;
Line 28, “An” should read --A--;
Line 31, “An” should read --A--;
Line 34, “An” should read --A--;
Line 37, “An” should read --A--;
Line 40, “An” should read --A--;
Line 43, “An” should read --A--;
Line 47, “An” should read --A--;
Line 51, “An” should read --A--;

UNITED STATES PATENT AND TRADEMARK OFFICE

CERTIFICATE OF CORRECTION

PATENT NO. : 6,285,848 B1
APPLICATION NO. : 09/092935
DATED : September 4, 2001
INVENTOR(S) : Shuichi Aita et al.

It is certified that error appears in the above-identified patent and that said Letters Patent is hereby corrected as shown below:

COLUMN 48 (Continued):
Line 53, "An" should read --A--; and
Line 56, "An" should read --A--.

Signed and Sealed this

Twenty-ninth Day of January, 2008

JON W. DUDAS
*Director of the United States Patent and Trademark Office*